US009815179B2

(12) United States Patent
Anderson et al.

(10) Patent No.: US 9,815,179 B2
(45) Date of Patent: Nov. 14, 2017

(54) REVERSIBLE RATCHETING TOOL WITH DUAL PAWLS

(71) Applicant: Apex Brands, Inc., Sparks, MD (US)

(72) Inventors: Alan D. Anderson, Willow Spring, NC (US); Yongsheng Xu, Shanghai (CN)

(73) Assignee: APEX BRANDS, INC., Apex, NC (US)

( * ) Notice: Subject to any disclaimer, the term of this patent is extended or adjusted under 35 U.S.C. 154(b) by 165 days.

(21) Appl. No.: 13/627,248

(22) Filed: Sep. 26, 2012

(65) Prior Publication Data

US 2014/0083259 A1 Mar. 27, 2014

(51) Int. Cl.
*B25B 13/46* (2006.01)

(52) U.S. Cl.
CPC ..... *B25B 13/463* (2013.01)

(58) Field of Classification Search
CPC ..... B25B 13/46; B25B 13/461; B25B 13/463; B25B 15/04
USPC ..... 81/60, 62, 63.1; 192/43.1
See application file for complete search history.

(56) References Cited

U.S. PATENT DOCUMENTS

| | | | |
|---|---|---|---|
| 755,569 | A | 3/1904 | Freeland |
| 2,601,064 | A | 6/1952 | Snyder |
| 2,978,081 | A | 4/1961 | Lundin |
| 3,577,816 | A | 5/1971 | Alexander et al. |
| 3,952,617 | A | 4/1976 | Gegg |
| 5,309,796 | A | 5/1994 | Jones |
| 5,782,147 | A | 7/1998 | Chaconas et al. |
| 6,070,499 | A | 6/2000 | Wisbey |
| 6,216,563 | B1 | 4/2001 | Hsieh |
| 6,330,843 | B1 | 12/2001 | Lin |
| 6,431,031 | B1 | 8/2002 | Hu |
| 6,450,066 | B1 | 9/2002 | Hu |
| 6,450,312 | B1 | 9/2002 | Hsiao |
| 6,453,779 | B2 | 9/2002 | Hu |
| 6,457,386 | B1 | 10/2002 | Chiang |
| 6,457,387 | B1 | 10/2002 | Hu |
| 6,457,389 | B1 | 10/2002 | Hu |

(Continued)

FOREIGN PATENT DOCUMENTS

| | | |
|---|---|---|
| CN | 2584358 | 11/2003 |

OTHER PUBLICATIONS

International Search Report and Written Opinion of the International Searching Authority dated Feb. 25, 2014 for PCT/US2013/061848.

(Continued)

*Primary Examiner* — Hadi Shakeri
(74) *Attorney, Agent, or Firm* — McNair Law Firm, P.A.

(57) ABSTRACT

A ratcheting tool includes a head and a handle, and a gear ring disposed in the head defining a first plurality of teeth defining a first arc having a first radius. A first pawl is disposed in the head and defines a front face, a rearward face, and a second plurality of teeth which defines a second arc having a second radius. A second pawl is disposed in the head and defines a front face, a rearward face, and a third plurality of teeth which defines a third arc having a third radius. When the first pawl and the second pawl are disposed with their rearward faces in vertical alignment and their longitudinal center axes are disposed in a common plane, the second arc of the first pawl is offset from the third arc of the second pawl in a direction parallel to the longitudinal center axes.

33 Claims, 18 Drawing Sheets

(56) References Cited

U.S. PATENT DOCUMENTS

| | | | | |
|---|---|---|---|---|
| 6,516,930 | B2 | 2/2003 | Chen | |
| 6,520,051 | B1 | 2/2003 | Hu | |
| 6,539,825 | B1 | 4/2003 | Lin | |
| D474,381 | S | 5/2003 | Lee et al. | |
| 6,568,299 | B2 | 5/2003 | Hu | |
| D477,756 | S | 7/2003 | Lee et al. | |
| 6,644,148 | B2 | 11/2003 | Hu | |
| 6,647,832 | B2 | 11/2003 | Hu | |
| D484,374 | S | 12/2003 | Lee et al. | |
| 6,666,112 | B2 | 12/2003 | Hu | |
| 6,666,117 | B2 | 12/2003 | Hu | |
| 6,722,234 | B2 | 4/2004 | Hu | |
| 6,732,614 | B2 | 5/2004 | Hu | |
| 6,745,647 | B2 | 6/2004 | Wang | |
| 6,758,641 | B2 | 7/2004 | Hu | |
| D496,237 | S | 9/2004 | Folkenroth et al. | |
| 6,807,882 | B2 | 10/2004 | Hu | |
| 6,918,323 | B2 | 7/2005 | Arnold et al. | |
| 6,923,095 | B2 | 8/2005 | Horvath | |
| D509,717 | S | 9/2005 | Folkenroth et al. | |
| 6,945,141 | B2 | 9/2005 | Hu | |
| 6,955,104 | B2 | 10/2005 | Hu | |
| 6,971,286 | B2 | 12/2005 | Hu | |
| 7,032,478 | B2 | 4/2006 | Hu | |
| 7,059,217 | B2 | 6/2006 | Horvath | |
| 7,146,881 | B2 | 12/2006 | Chang | |
| 7,171,873 | B2 | 2/2007 | Horvath | |
| 7,178,429 | B2 | 2/2007 | Lin | |
| 7,207,243 | B1 | 4/2007 | Lee | |
| 7,234,372 | B2 | 6/2007 | Hu | |
| 7,237,460 | B2 | 7/2007 | Hu | |
| 7,263,919 | B2 * | 9/2007 | Arnold | 81/63.1 |
| 7,270,035 | B2 | 9/2007 | Lu | |
| 7,353,735 | B2 | 4/2008 | Patel et al. | |
| 7,938,043 | B2 | 5/2011 | Hu | |
| 2004/0083860 | A1 | 5/2004 | Arnold et al. | |
| 2004/0089108 | A1 * | 5/2004 | Chang | 81/62 |
| 2013/0154202 | A1 | 6/2013 | Low et al. | |
| 2013/0228049 | A1 * | 9/2013 | Shen | 81/63.1 |

OTHER PUBLICATIONS

Extended European Search Report for European Application No. 13840786 dated Mar. 22, 2016.

Second Patent Examination Report for Australian Application No. 2013323577 dated Jul. 7, 2016.

Second Office for Chinese Application No. 201380060054.0 dated Oct. 9, 2016.

EPC Communication pursuant to Article 94(3) for European Application No. 13840786.1 dated Feb. 10, 2017.

Third Office Action for Chinese Application No. 201380060054.0 dated Apr. 1, 2017.

Office Action dated Dec. 24, 2015, for corresponding Chinese application No. 201380060054.0.

* cited by examiner

REVERSIBLE RATCHETING TOOL WITH DUAL PAWLS

FIELD OF THE INVENTION

The present invention relates generally to hand tools. More particularly, the present invention relates to a wrench that includes a ratcheting feature.

BACKGROUND

Ratcheting tools, for example ratchets and wrenches, often include a generally cylindrical ratchet gear and a pawl that controls the gear's ratcheting direction so that the gear may rotate in one direction but is prevented from rotation in the other. It is often desirable to utilize ratchet wrenches in environments, such as an engine compartment of an automobile, where space restrictions limit the ability to adequately rotate a standard wrench and, therefore, fastener. As well, ratchet wrenches are desirable wherein removal and reapplication of a standard wrench to a fastener are similarly limited.

Even with the advantages offered by known ratchet wrenches, it is not uncommon for the ratchet wrenches to be used in situations where there is insufficient clearance to fully rotate the wrench and obtain an effective ratcheting action for either tightening or loosening a fastener. In order to overcome this problem, ratchet wrenches with a greater number of teeth on the gear, and corresponding pawl, have been utilized. This reduces the back swing arc and permits use of the wrench in more confined spaces. However, the greater number of teeth results in a plurality of thinner (or fine) teeth, each of which has reduced mechanical strength than the thicker teeth on a standard ratchet. As such, there is a greater possibility of damage to the fine teeth.

The present disclosure recognizes and addresses considerations of prior art constructions and methods.

SUMMARY OF THE DISCLOSURE

One embodiment of a ratcheting tool in accordance with the present disclosure includes a head and a handle attached to the head, and a gear ring disposed in the head and defining a first plurality of teeth about an outer circumference of the gear ring so that the first plurality of teeth define a first arc having a first radius. A first pawl is disposed in the head so that the first pawl is slidable laterally with respect to a longitudinal center axis of the handle between a first position in which the first pawl is disposed between the head and the gear ring so that the head transmits torque through the first pawl in a first rotational direction, and a second position in which the first pawl is disposed between the head and the gear ring so that the head transmits torque through the first pawl in an opposite second rotational direction. The first pawl defines a front face and a rearward face extending between an upper surface and a lower surface of the first pawl, and a second plurality of teeth on the front face of the first pawl for engaging the first plurality of teeth, the front face being concave so that the second plurality of teeth defines a second arc having a second radius. A second pawl is disposed in the head so that the second pawl is slidable laterally with respect to a longitudinal center axis of the handle between a first position in which the second pawl is disposed between the head and the gear ring so that the head transmits torque through the second pawl in the first rotational direction, and a second position in which the second pawl is disposed between the head and the gear ring so that the head transmits torque through the second pawl in the opposite second rotational direction. The second pawl defines a front face and a rearward face extending between an upper surface and a lower surface of the second pawl, and a third plurality of teeth on the front face of the second pawl for engaging the first plurality of teeth, the front face being concave so that the third plurality of teeth defines a third arc having a third radius. When the first pawl and the second pawl are disposed with the rearward faces of the first pawl and the second pawl in vertical alignment so that the longitudinal center axes of the first pawl and the second pawl are disposed in a common plane, the second arc of the first pawl is offset from the third arc of the second pawl in a direction that is parallel to the longitudinal center axes of the first pawl and the second pawl.

An alternate embodiment of a ratcheting tool in accordance with the present disclosure includes a head and a handle attached to the head, and a gear ring disposed in the head and defining a first plurality of teeth about an outer circumference of the gear ring. A first pawl is disposed in the head so that the first pawl is slidable laterally and longitudinally with respect to a longitudinal center axis of the handle between a first position in which the first pawl is disposed between the head and the gear ring so that the head transmits torque through the first pawl in a first rotational direction, and a second position in which the first pawl is disposed between the head and the gear ring so that the head transmits torque through the first pawl in an opposite second rotational direction. The first pawl defines a front face and a rearward face extending between an upper surface and a lower surface of the first pawl, and a second plurality of teeth on the front face of the first pawl for engaging the first plurality of teeth, the front face being concave. A second pawl is disposed in the head so that the second pawl is slidable laterally and longitudinally with respect to a longitudinal center axis of the handle between a first position in which the second pawl is disposed between the head and the gear ring so that the head transmits torque through the second pawl in the first rotational direction, and a second position in which the second pawl is disposed between the head and the gear ring so that the head transmits torque through the second pawl in the opposite second rotational direction. The second pawl defines a front face and a rearward face extending between an upper surface and a lower surface of the second pawl, and a third plurality of teeth on the front face of the second pawl for engaging the first plurality of teeth, the front face being concave. When the first pawl and the second pawl are disposed with the rearward faces of the first pawl and the second pawl in vertical alignment so that the longitudinal center axes of the first pawl and the second pawl are disposed in a common plane, the second plurality of teeth of the first pawl is offset from the third plurality of teeth of the second pawl in a direction that is parallel to the longitudinal center axes of the first pawl and the second pawl.

The accompanying drawings, which are incorporated in and constitute a part of this specification, illustrate one or more embodiments of the disclosure and, together with the description, serve to explain the principles of the various embodiments.

BRIEF DESCRIPTION OF THE DRAWINGS

A full and enabling disclosure of the present disclosure, including the best mode thereof, directed to one of ordinary skill in the art, is set forth in the specification, which makes reference to the appended drawings, in which.

Figure 1:
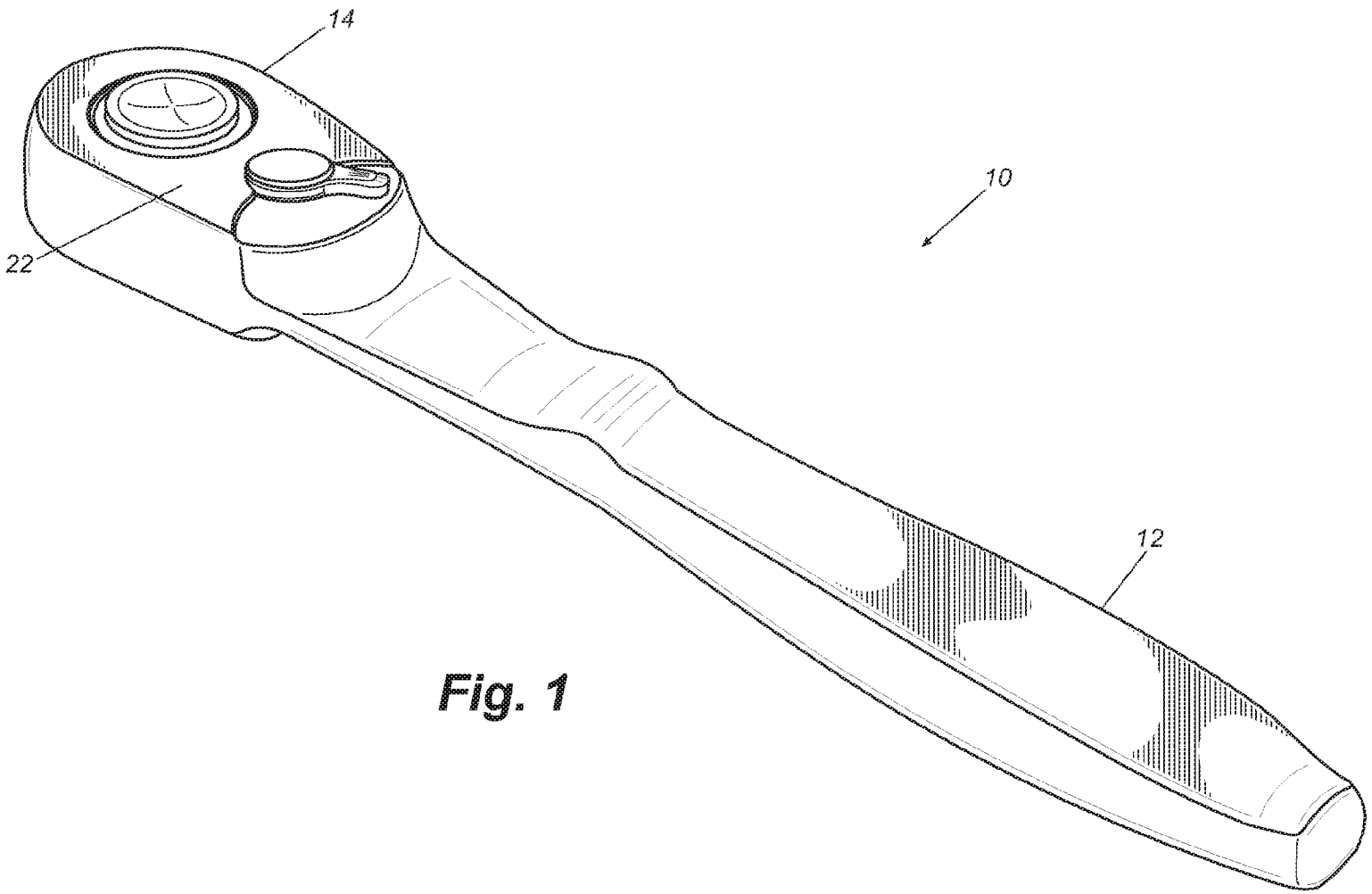
FIG. 1 is a perspective view of a ratcheting tool in accordance with an embodiment of the present disclosure.
Figure 6A:
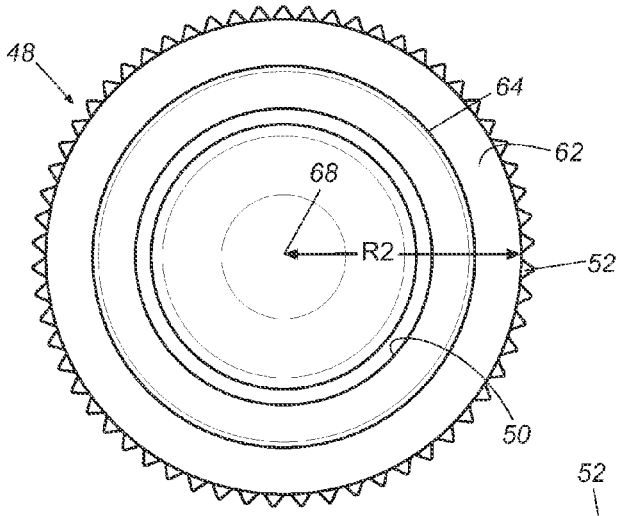
Figure 6B:
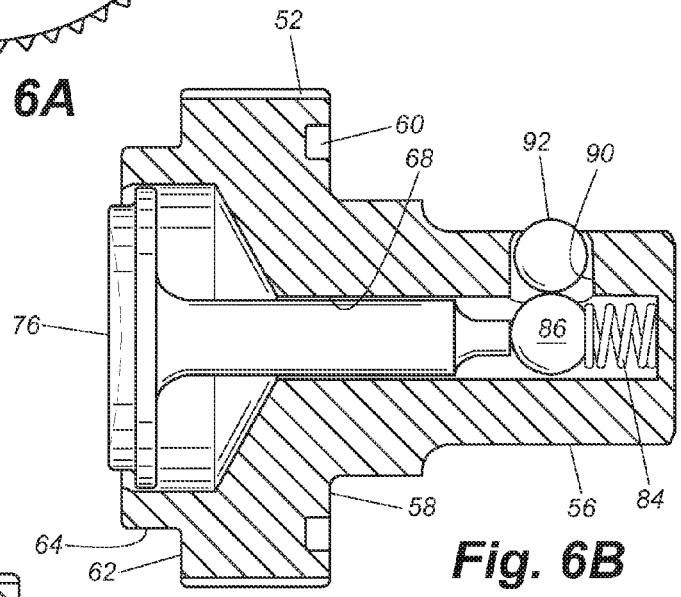
Figure 6C:
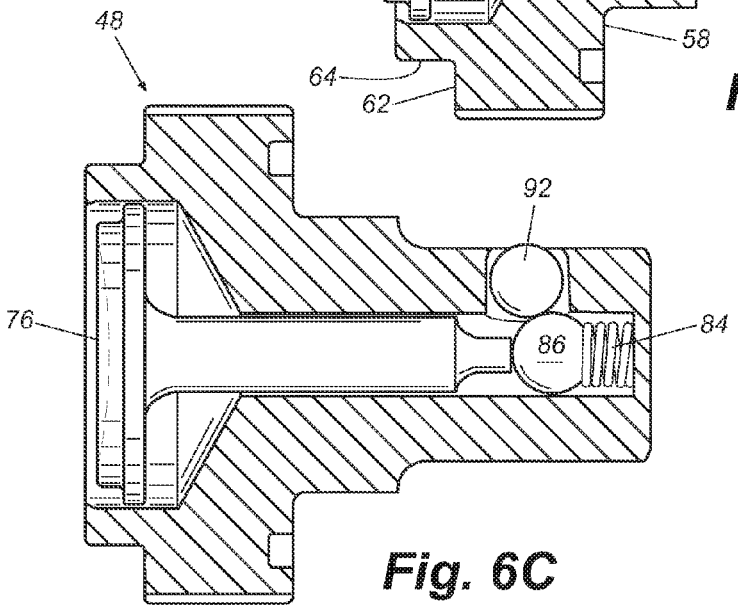
Figure 7:
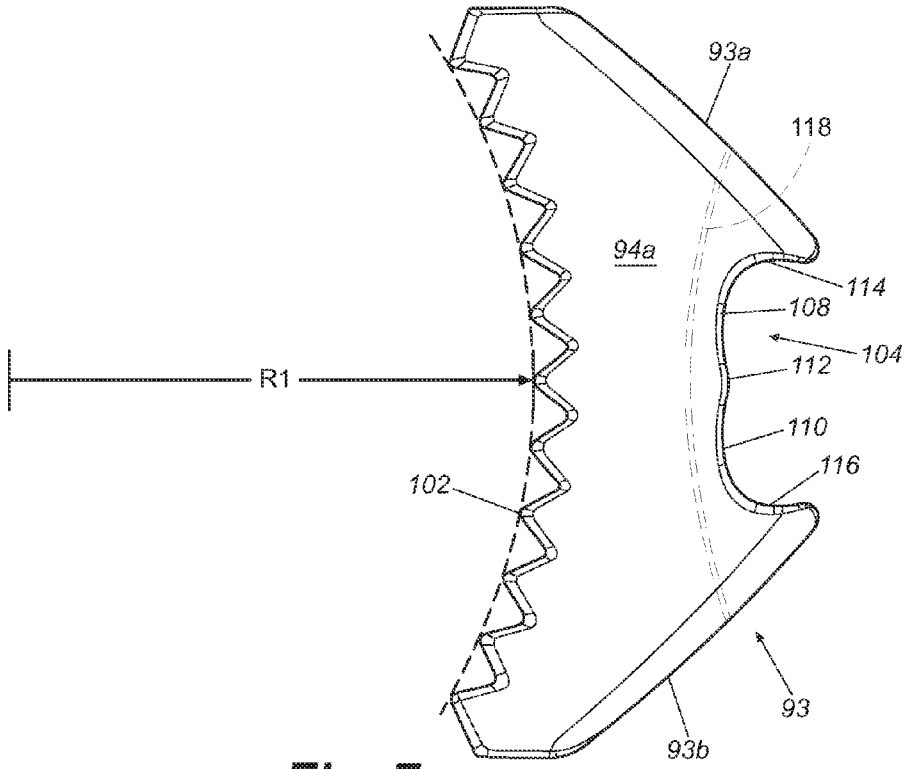
Figure 8:
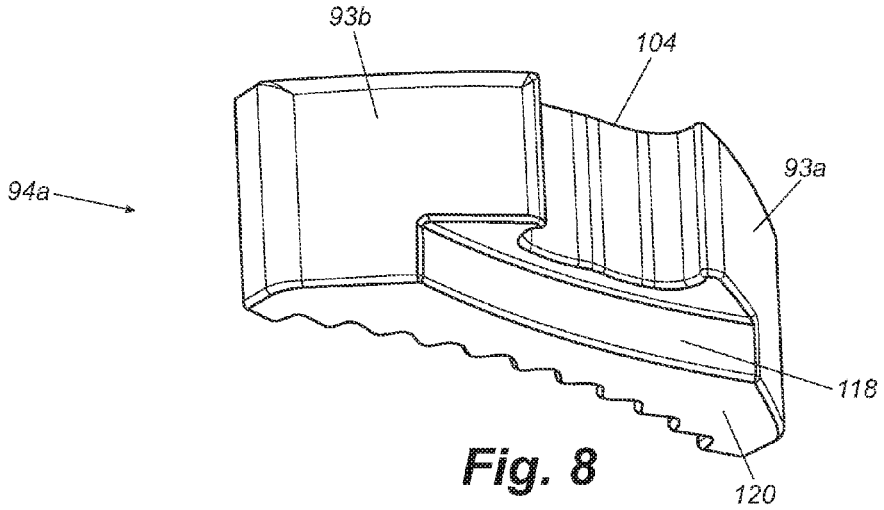
Figure 9:
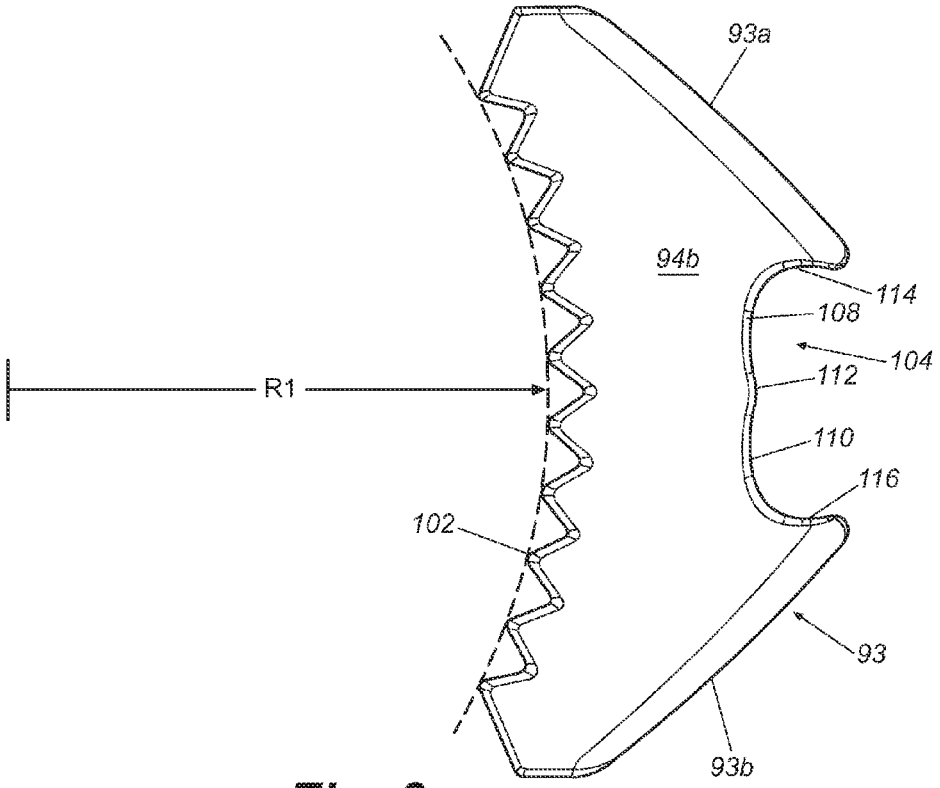
Figure 10:
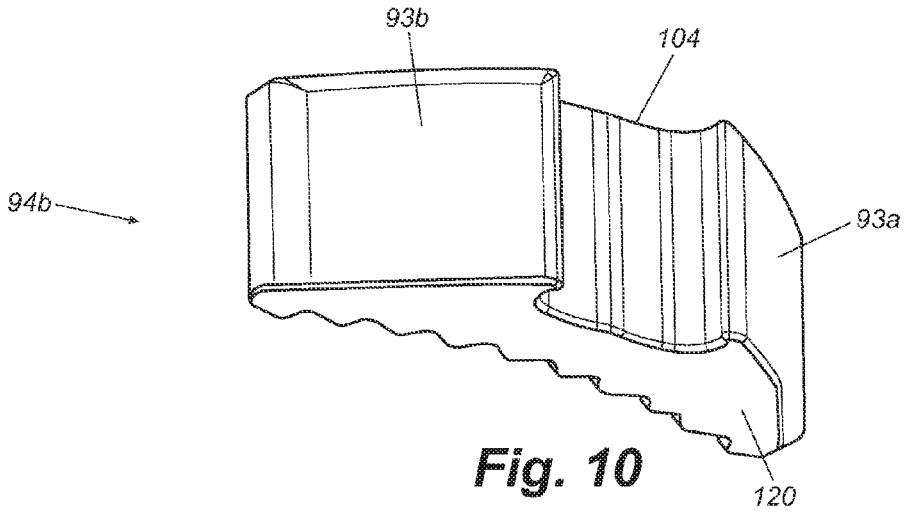
Figure 11:
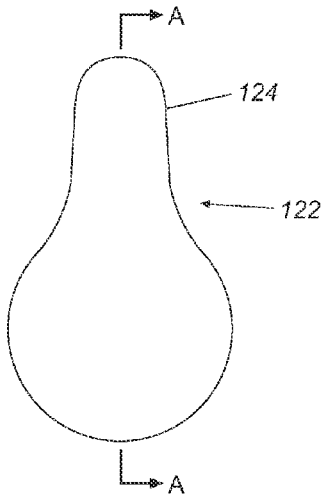
Figure 12:
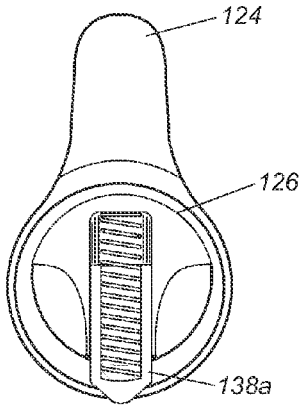
Figure 11A:
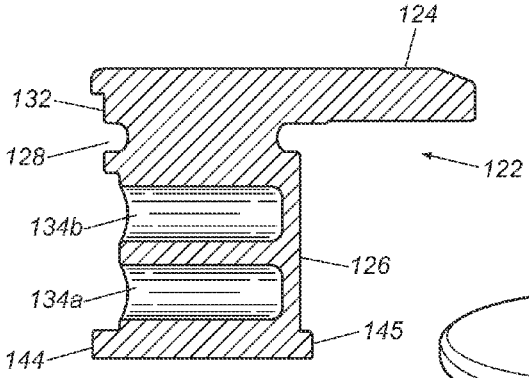
Figure 13:
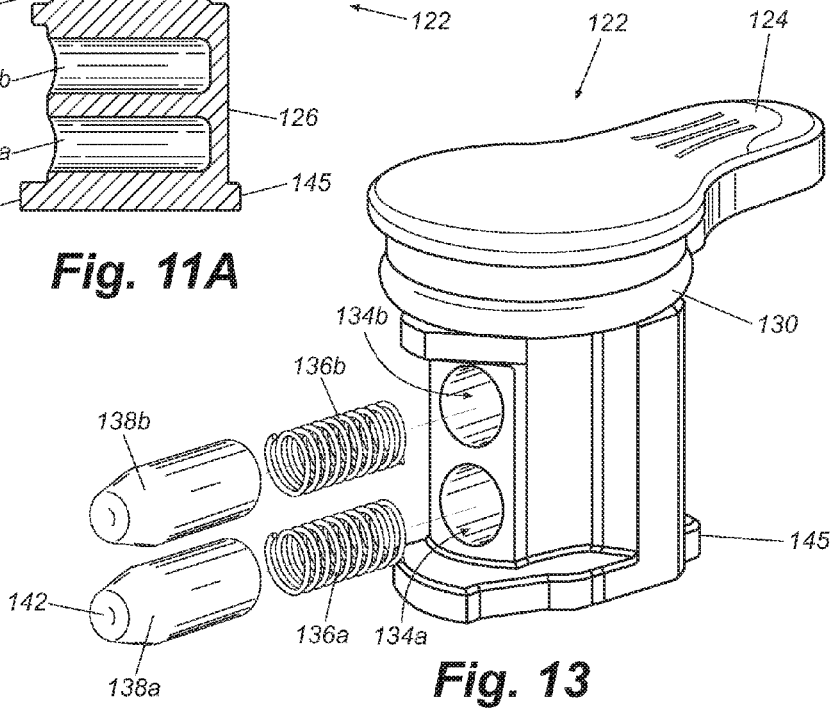
Figure 14:
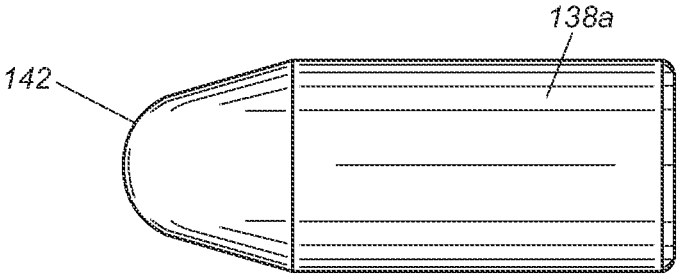
Figure 14A:
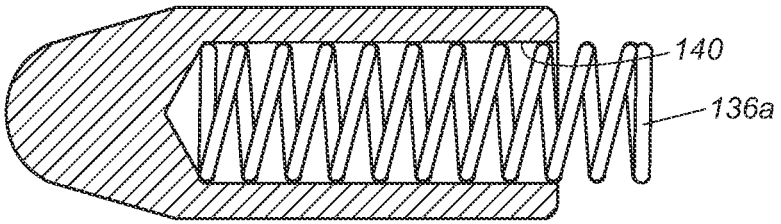
Figure 15:
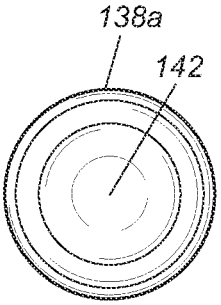
Figure 16:
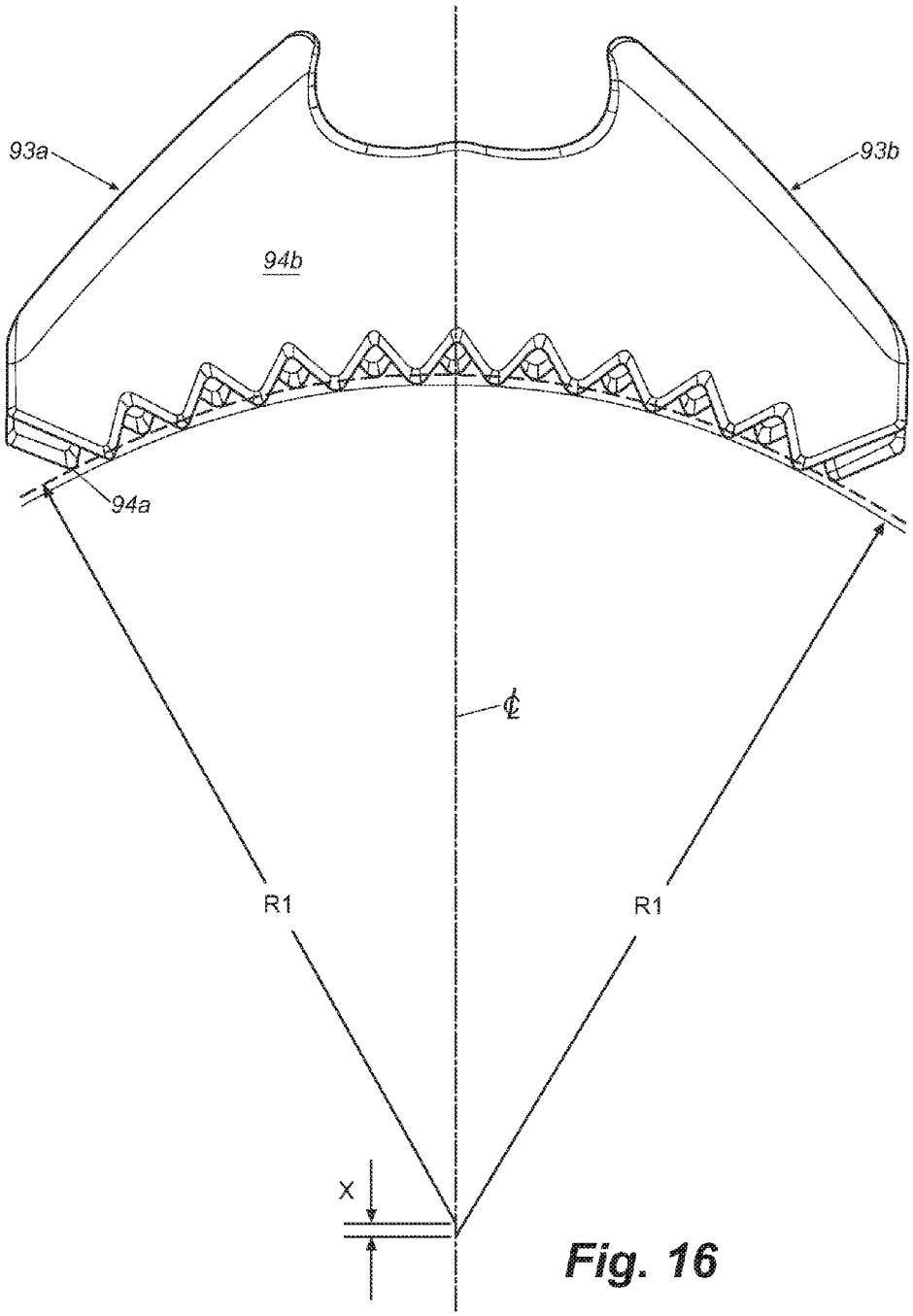
Figure 17:
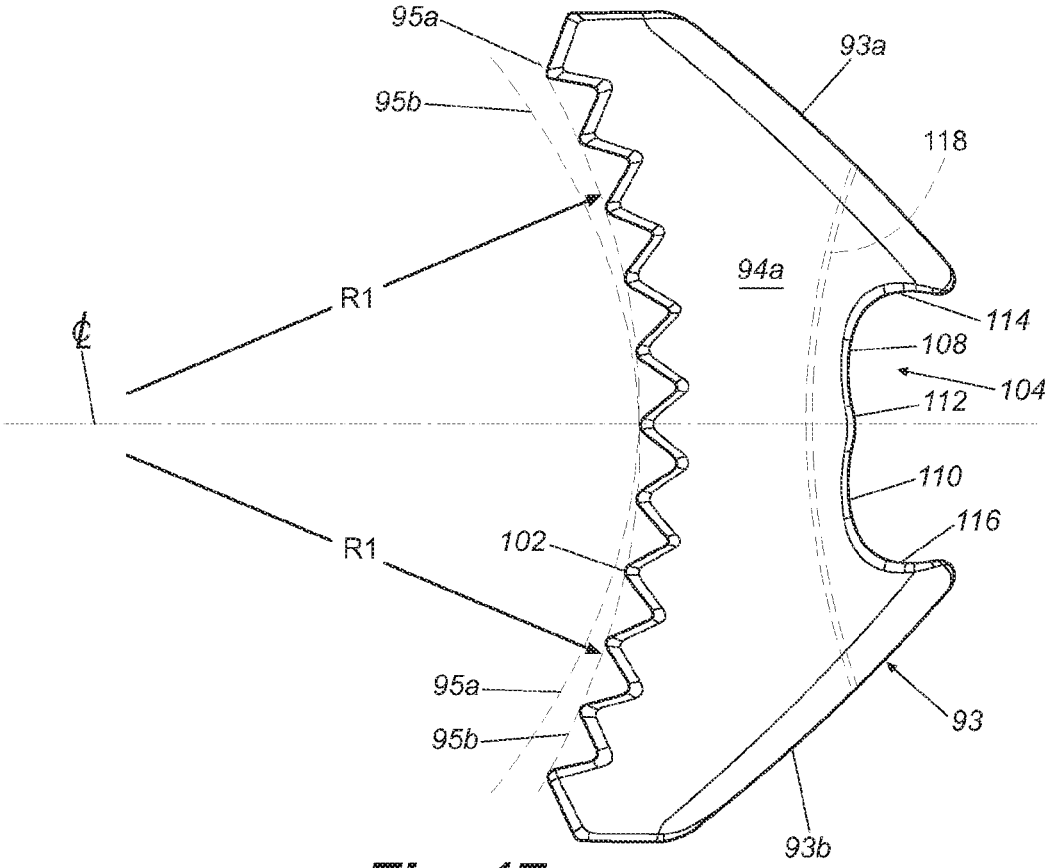
Figure 18:
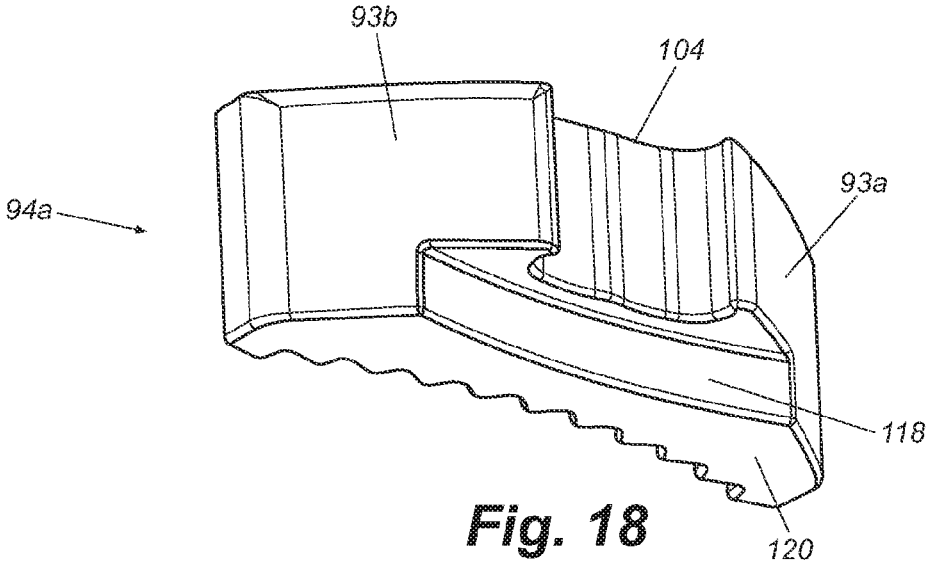
Figure 19:
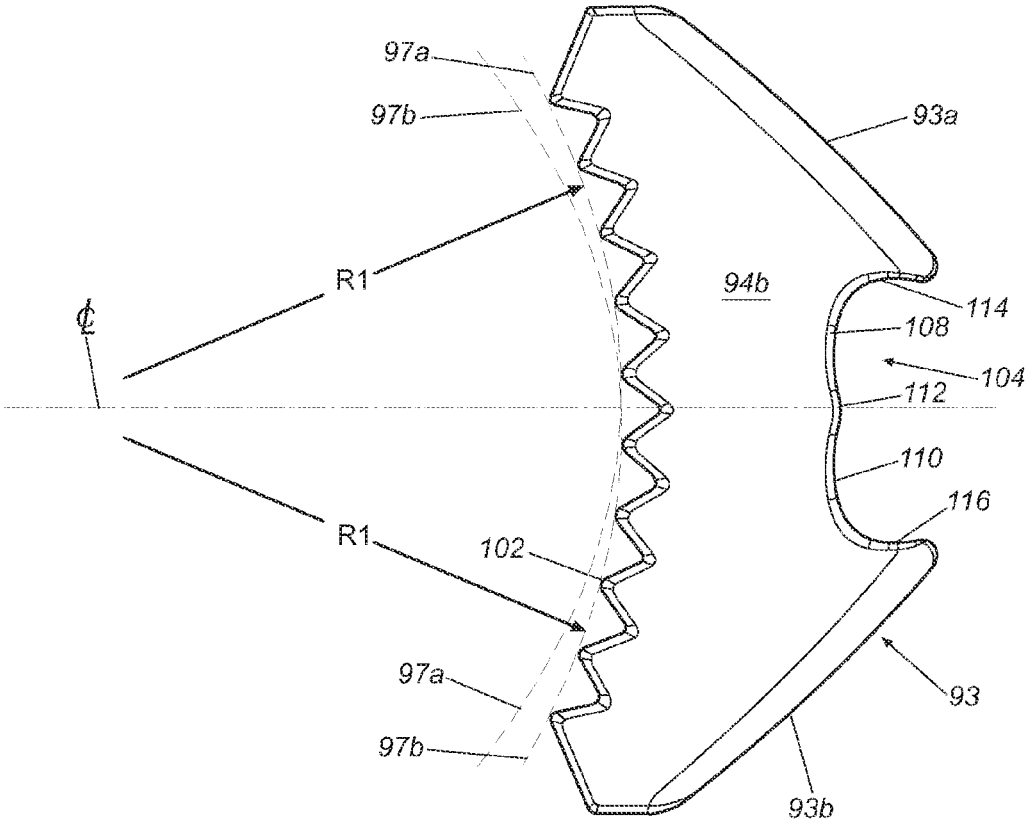
Figure 20:
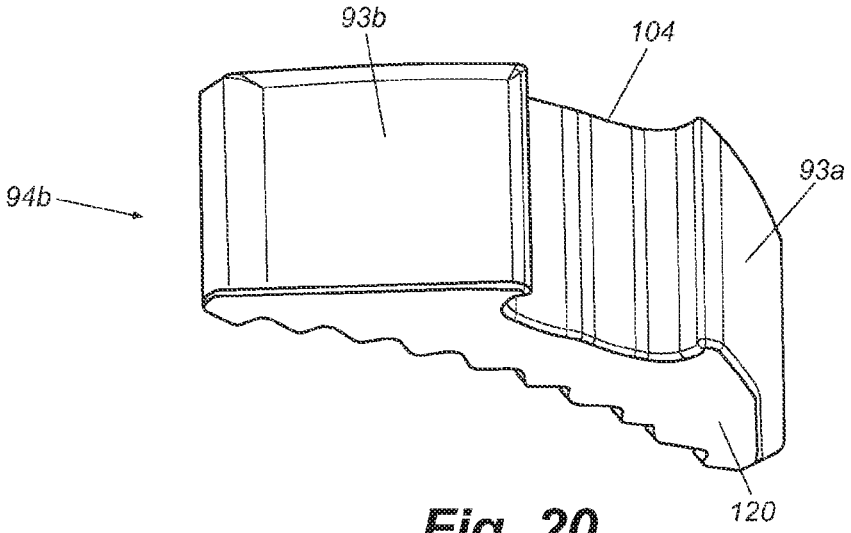

Each of FIGS. 4A through 4D is a top view, partly in section, of the ratcheting tool as in FIG. 1;

Each of FIGS. 5A through 5D is an elongated view of a portion of the components shown in FIG. 4;

FIG. 6A is a top view of a ratchet gear and release button of the ratcheting tool as in FIG. 1;

Each of FIGS. 6B and 6C is a side view, partly in section, of the ratchet gear and release button as in FIG. 6A;

FIG. 7 is a top view of a lower pawl of a ratcheting tool as in FIG. 1;

FIG. 8 is a perspective view of the lower pawl as in FIG. 7;

FIG. 9 is a top view of an upper pawl of a ratcheting tool as in FIG. 1;

FIG. 10 is a perspective view of the upper pawl as in FIG. 9;

FIG. 11 is a top view of the reversing lever of the ratcheting tool shown in FIG. 1;

FIG. 11A is a partial side view, in section, of the reversing lever of FIG. 11;

FIG. 12 is a bottom view, partly in section, of the reversing lever shown in FIG. 11;

FIG. 13 is an exploded view of the reversing lever shown in FIG. 11;

FIG. 14 is a side view of a lower pusher as shown in FIG. 13;

FIG. 14A is a cross-sectional view of the lower pusher shown in FIG. 14;

FIG. 15 is a front view of the lower pusher shown in FIG. 14;

FIG. 16 is a top view of the upper and the lower pawls of the ratcheting tool shown in FIG. 1, in a stacked configuration;

FIG. 17 is a top view of a lower pawl of a ratcheting tool in accordance with an alternate embodiment of the present disclosure;

FIG. 18 is a perspective view of the lower pawl as in FIG. 17;

FIG. 19 is a top view of an upper pawl of a ratcheting tool in accordance with an alternate embodiment of the present disclosure;

FIG. 20 is a perspective view of the upper pawl as in FIG. 19; and

Figure 21:
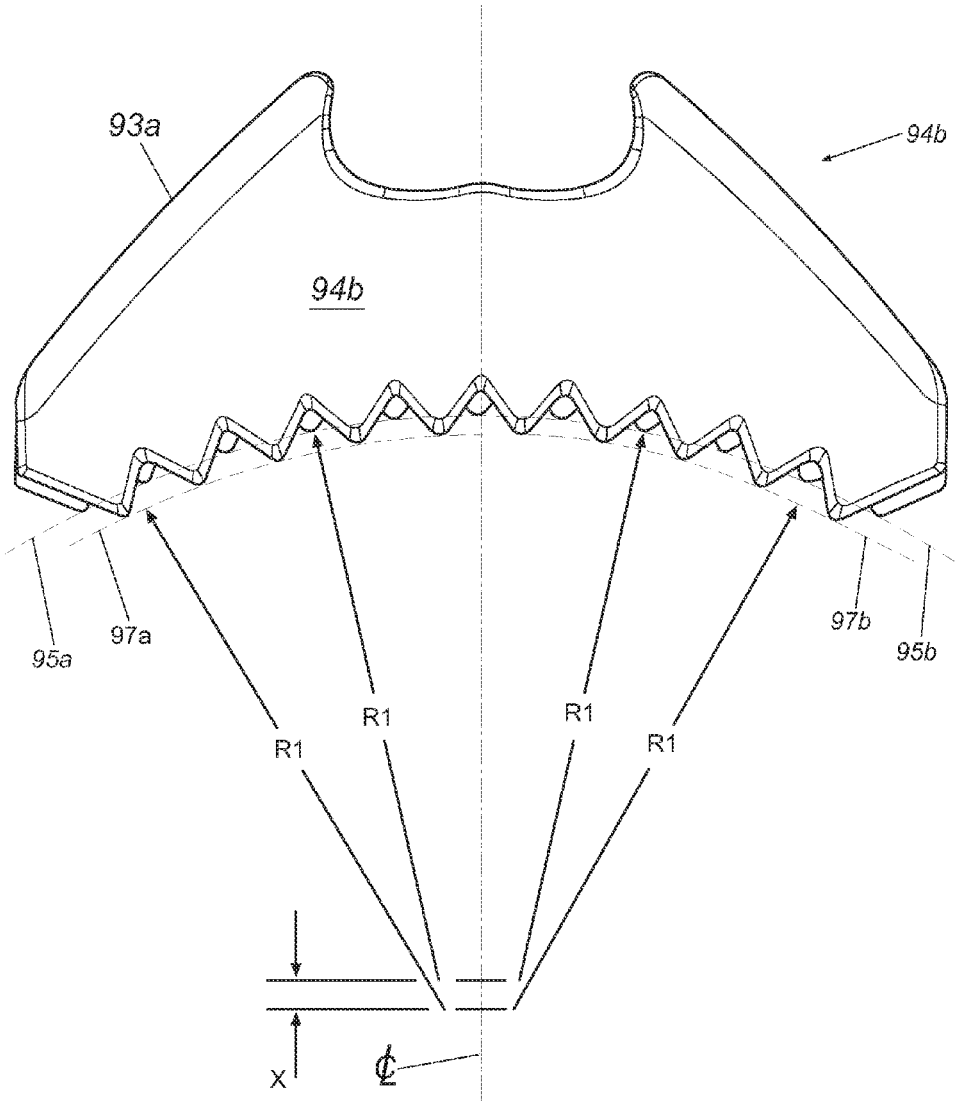

FIG. 21 is a top view of the upper and lower pawls, as shown in FIGS. 17 and 19, respectively, in a stacked configuration.

Repeat use of reference characters in the present specification and drawings is intended to represent same or analogous features or elements of the invention.

DETAILED DESCRIPTION

Reference will now be made in detail to various embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a ratcheting tool 10 includes an elongated arm, which may be formed as a handle 12 from stainless steel, metal alloys or other suitable materials. The length of handle 12 may vary depending on the application of ratcheting tool 10. A head 14 extends from the handle 12, and the head and handle may be integrally formed from the same material.

Figure 2:
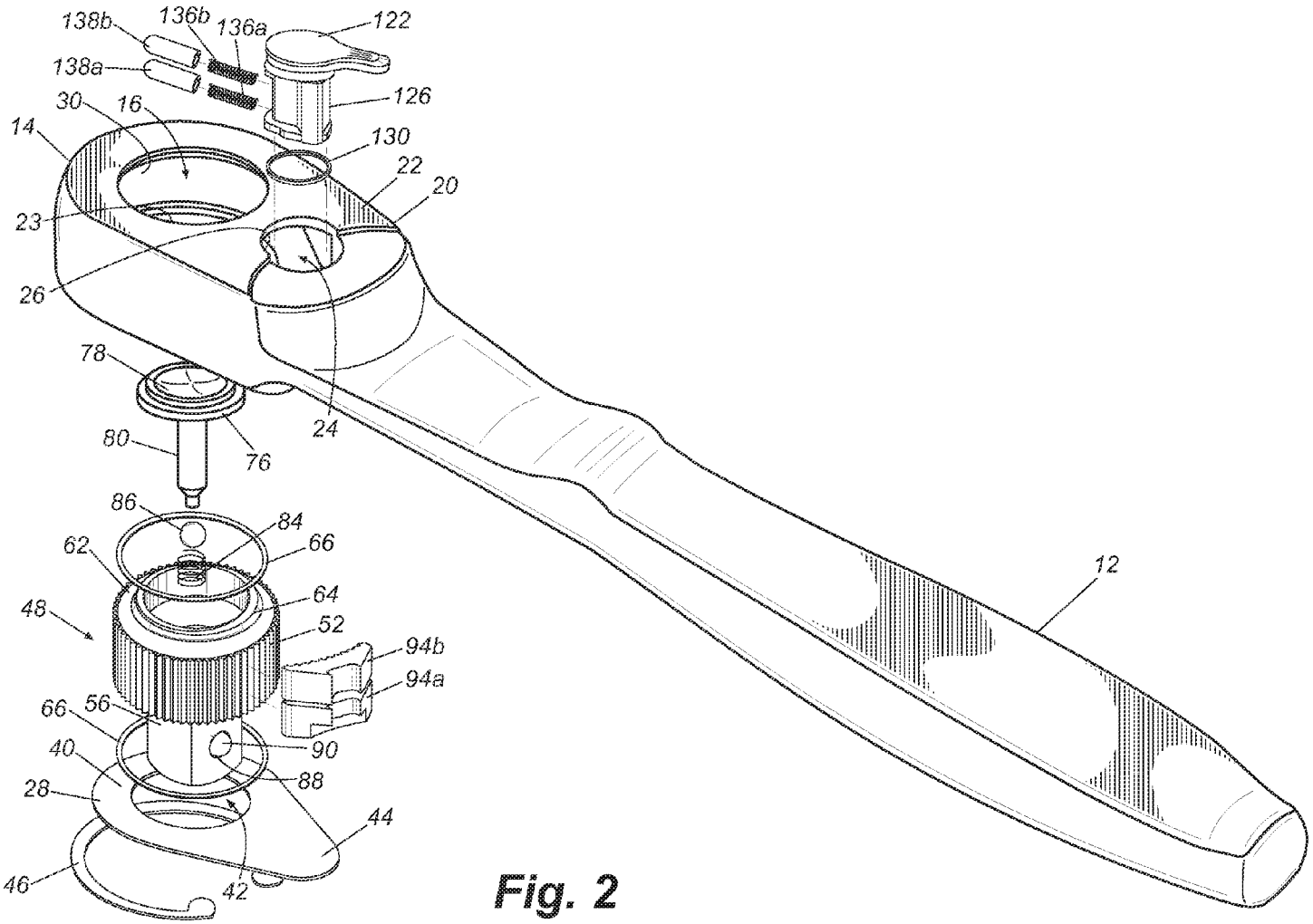
FIG. 2 is an exploded view of the ratcheting tool as in FIG. 1.
Figure 3A:
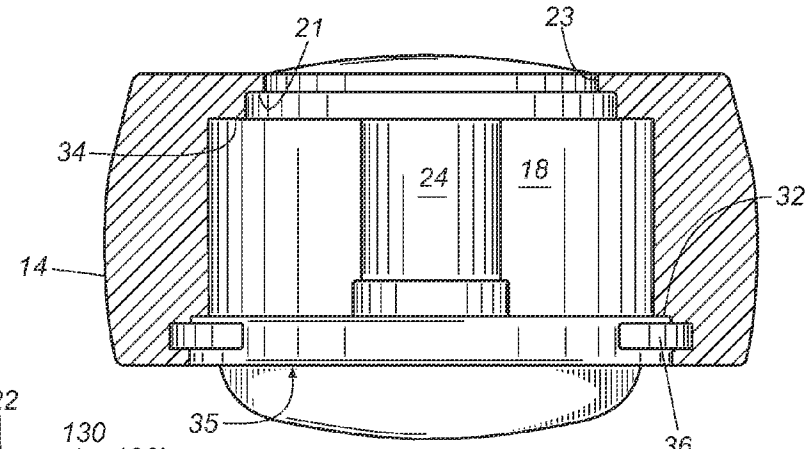
FIG. 3A is a sectional view of the body of ratcheting tool as in FIG. 1.
Figure 3B:
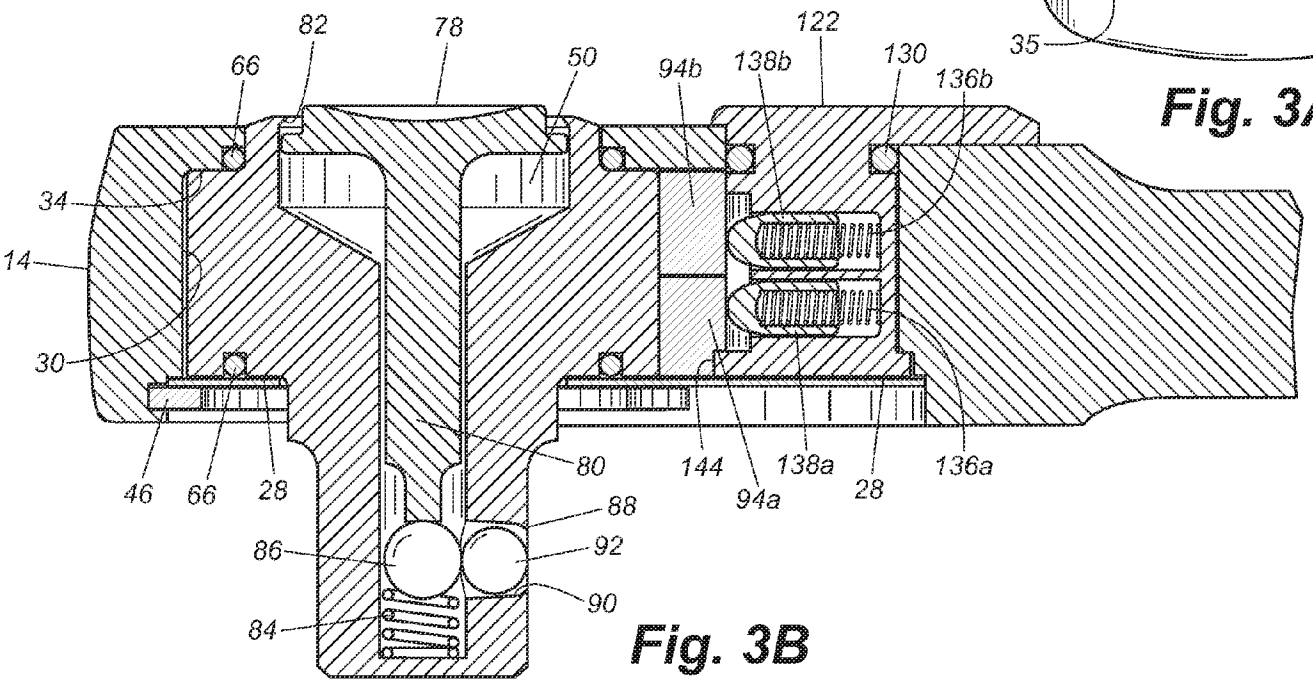
FIG. 3B is a partial sectional view of the ratcheting tool as in FIG. 1.

Referring to FIGS. 2, 3A, and 3B, head 14 defines a relatively large and generally cylindrical through-hole compartment 16. A web portion 20 is intermediate to head 14 and handle 12 and defines a smaller, wedge-shaped compartment 18 (see also FIGS. 4A and 4B). A generally cylindrical compartment 24 extends through a top face 22 into web 20 at a hole 26 and overlaps compartment 18. Compartment 18 is closed above by top face 22 and opens into both compartments 16 and 24. The underside of head 14 is open and receives a cover 28 that secures certain components of ratcheting tool 10 within compartments 16, 18, and 24, as described in greater detail below.

A wall 30 defines compartment 16 between a radially outward extending ledge 32 at one end and a radially inward extending ledge 34 at its other end. An annular groove 36 is defined in a vertical wall extending down from ledge 32 and surrounding most of compartment 16.

Cover 28 has an annular portion 40 defining a hole 42 and a tab portion 44 extending from annular portion 40. An opening 35 in the bottom of head 14 and web 20 receives cover 28 so that annular portion 40 sits on ledge 32. Annular groove 36 receives a C-clip 46 to secure cover 28 between the C-clip and ledge 32 so that cover 28 is held in position over compartments 16, 18, and 24.

Compartment 16 receives an annular gear ring 48 having an inner surface 50 that is concentric with wall 30 of head 14. As shown in FIGS. 6A through 6C, the outer circumference of gear ring 48 defines an annular array of vertically-aligned teeth 52. More specifically, the embodiment shown preferably includes sixty (60) gear teeth 52 evenly spaced about the outer surface of gear ring, meaning the gear ring 48 has an index of 6°. The gear ring's bottom side defines an extension portion 56 surrounded by a flat annular shoulder 58 that defines an annular groove 60. On the top side, a top ledge 62 surrounds an upwardly extending wall 64. Gear ring 48 fits into compartment 16 so that wall 64 extends through a hole 23 in top face 22 and so that ledge 62 abuts ledge 34. When cover 28 is secured to head 14, extension portion 56 extends through hole 42. Circular portion 40 abuts shoulder 58, thereby retaining gear ring 48 in compartment 16.

Extension portion 56 and wall 64 fit through hole 42 and hole 23, respectively, with sufficient clearance so that the gear ring is secured in the radial direction yet is permitted to rotate with respect to head 14. A lower O-Ring 66 is received in annular groove 60 and abuts cover 28, while an upper O-ring extends around wall 64 between ledges 21 and 62. The O-rings aid in smooth rotation of gear ring 48 and minimize the amount of dirt and debris that can enter compartment 16. O-Rings 66 may be formed from pliable rubbers, silicones, metals, or other suitable material.

Extension portion 56 is square shaped in cross-section and is adapted to receive a standard three-eighths (⅜) inch drive socket, which should be well understood in the art. Extension 56 may also be sized to fit one-quarter (¼) inch drive, one-half (½) inch drive, or other drive size sockets as desired.

Inner surface 50 of gear ring 48 surrounds a blind bore 68 centered around the axis of gear ring 48. Bore 68 receives a push button 76 having an annular top 78 and a cylindrical shaft 80. The top end of bore 68 defines a shoulder 82 that is peened inward to retain button 76 in the bore. A spring 84 and ball 86 in the bottom of bore 68 bias button 76 upward against shoulder 82. A cylindrical bore 90 intersects bore 68 at a right angle and receives a ball 92. An edge 88 is peened inward to retain the ball in the bore.

Ball 86 controls the position of ball 92 within bore 90. Normally, when spring 84 and ball 86 push the top of button 76 up against shoulder 82, ball 86 is aligned with ball 92, thereby pushing ball 92 out against edge 88 of bore 90. In this position, a portion of ball 92 extends out of bore 90 to retain a socket on extension 56. To remove the socket, the operator pushes push button 76 down against spring 84. This moves ball 86 below bore 90 and aligns a narrowed end of shaft 80 with ball 92, thereby allowing ball 92 to move back into bore 90 and releasing the socket.

Referring to FIGS. 4A through 4D, compartment 18 receives a pair of generally wedge-shaped pawls, more specifically, a lower pawl 94*a* and an upper pawl 94*b*, in a stacked configuration between side walls 98 and 100. Cover 28 and top face 22 (FIG. 2) of web 20 retain lower and upper pawls 94*a* and 94*b* from below and above. Walls 98 and 100 are formed so that vertical planes (i.e. planes perpendicular to the page) defined by the walls intersect a vertical plane 99 that passes through the center of compartments 16 and 24 (see FIGS. 2 and 3A) at an angle such that compartment 18 optimizes the load-bearing and ratcheting capabilities of ratcheting tool 10. The size of the angle may vary depending on the tool's intended use. A larger angle, for example, allows for greater load-carrying characteristics between lower and upper pawls 94*a* and 94*b* and gear ring 48, while a smaller angle provides for better ratcheting and reversing. Thus, the angle chosen in a given instance preferably provides the best combination of gear/pawl tooth loading and clearance for the pawls during ratcheting and reversing. In a preferred embodiment, the angle between plane 99 and each of side walls 98 and 100 is 31 degrees and is preferably within a range of 27 degrees to 35 degrees.

As shown in FIGS. 7 and 8, lower pawl 94*a* defines a plurality of vertically-aligned teeth 102 across the pawl's front face in an arc having a radius R1. In the illustrated embodiment, lower pawl includes eleven teeth 102, the tips of the teeth are rounded slightly, and R1 is measured to the rounded tips of the teeth. The radius R1 is the same as a radius R2 (FIG. 6A) between the center 68 of gear ring 48 and the troughs of its teeth 52. Because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth. As well, in the embodiment shown, teeth 102 are evenly spaced on the pawl's front face so that lower pawl 94*a* has the same index, that being 6°, as the gear teeth 52.

The rearward face 93 of lower pawl 94*a* defines a pocket 104 having two curved portions 108 and 110 separated by a bridge 112 and having symmetric rearwardly-extending sides 114 and 116. A notch 118 extends into the back end of lower pawl 94*a* from a bottom surface 120. The remainder of rearward face 93 of lower pawl 94*a* is defined by first and second smooth, continuous portions 93*a* and 93*b* disposed on opposite sides of pocket 104.

As shown in FIGS. 9 and 10, upper pawl 94*b* defines a plurality of vertically-aligned teeth 102 across the pawl's front face in an arc having a radius R1. In the illustrated embodiment, upper pawl includes ten teeth 102, the tips of the teeth are rounded slightly, and R1 is measured to the rounded tips of the teeth. The radius R1 is the same as a radius R2 (FIG. 6A) between the center 68 of gear ring 48 and the troughs of its teeth 52. Similarly to lower pawl 94*a*, because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth. As well, in the embodiment shown, teeth 102 are evenly spaced on the pawl's front face so that upper pawl 94*b* has the same index, that being 6°, as the gear teeth 52.

Additionally, rearward face 93 of upper pawl 94*b* defines a pocket 104 having two curved portions 108 and 110 separated by a bridge 112 and having symmetric rearwardly-extending sides 114 and 116. Similarly to lower pawl 94*a*, the remainder of rearward face 93 of upper pawl 94*b* is defined by first and second smooth, continuous portions 93*a* and 93*b* disposed on opposite sides of pocket 104. Preferably, first and second portions 93*a* and 93*b* of upper pawl's rearward face 93 are formed identically to first and second portions 93*a* and 93*b* of lower pawl's rearward face 93.

Referring now to FIG. 16, a top view of upper and lower pawls 94*b* and 94*a* in a stacked configuration is provided in which the rearward faces, more specifically, first and second portions 93*a* and 93*b* of each rearward face, of upper pawl 94*b* and lower pawl 94*a*, are vertically aligned. As well, the pawls are positioned such that their longitudinal center axes lie in a common vertical plane. As previously discussed, gear ring 48 preferably defines 60 gear teeth 52 evenly spaced about its outer circumference, meaning the teeth are disposed every 6°. Similarly, teeth 102 of lower pawl 94*a* and upper pawl 94*b* are disposed along their respective front faces at 6° increments. Note, however, that when their longitudinal center axes are aligned, teeth 102 of lower pawl 94*a* are circumferentially offset from teeth 102 of upper pawl 94*b* by approximately one-half pitch, meaning by approximately 3° in the present case. As discussed in greater detail below, the effect of the circumferential offset of the pawl teeth is equivalent to doubling the number of gear teeth 52 from 60 teeth to 120 teeth. As such, the ratcheting index of the wrench is decreased from approximately 6° to approximately 3°.

Still referring to FIG. 16, in the embodiment shown, an arc defined by teeth 102 of lower pawl 94*a* is offset from an arc defined by teeth 102 of upper pawl 94*b* in a direction that is parallel to the longitudinal center axes of the pawls. In short, the net effect of the offset is that the pawl having the fewer number of teeth, that being upper pawl 94*b*, is "thicker" than the lower pawl 94*a* in a direction parallel to the longitudinal center axes of the pawl. As shown, the offset (X) is preferably between approximately 0.002 to 0.008 inches, most preferably being approximately 0.005 inches.

Referring to FIGS. 11, 11A, 12 and 13, a reversing lever 122 includes a handle portion 124 and a bottom portion 126. The outer surface of bottom 126 defines an annular groove 128 that receives an O-ring 130, which extends slightly outward of groove 128. Groove 128 is located proximate handle portion 124 such that an annular shelf 132 extends between groove 128 and the front of handle 124. Bottom 126 defines a lower blind bore 134*a* and an upper blind bore 134*b* that receive a lower spring 136*a* and pusher 138*a*, and an upper spring 136*b* and pusher 138*b*, respectively. Referring to FIGS. 14, 14A and 15, lower pusher 138*a* is cylindrical in shape and defines a blind bore 140 in its rear end and a rounded front end 142. Bore 140 is adapted to receive lower spring 136*a* so that the spring biases lower pusher 138*a* radially outward from bore 134. Upper spring 136*b* and upper pusher 138*b* are identical in construction to lower spring 136*a* and lower pusher 138*a*.

Referring to FIGS. 2, 3B, 11A and 13, hole 26 in web 20 receives the lever's bottom portion 126. The diameter of bottom portion 126 is approximately equal to the diameter of hole 26, although sufficient clearance is provided so that the reversing lever rotates easily in the hole. Upon insertion of bottom portion 126 into hole 26, the hole's side pushes O-ring 130 radially inward into groove 128 so that the O-ring thereafter inhibits the entrance of dirt into the compartment. Referring also to FIG. 7, lower pusher 138*a* extends into pocket 104 of lower pawl 94*a* and engages curved portions 108 and 110 and sides 114 and 116, depending on the position of the pawl and lever. Similarly, upper pusher 138*b* extends into pocket 104 of upper pawl 94*b* and engages curved portion 108 and 110 and sides 114 and 116, depending on the position of the pawl and lever. A radially outward extending lip 144 at the bottom of the lever fits into notch 118 in the pawl, and a lip 145 extends into a groove at the bottom of compartment 24, thereby axially retaining lever 122 its compartment.

Figure 4A:
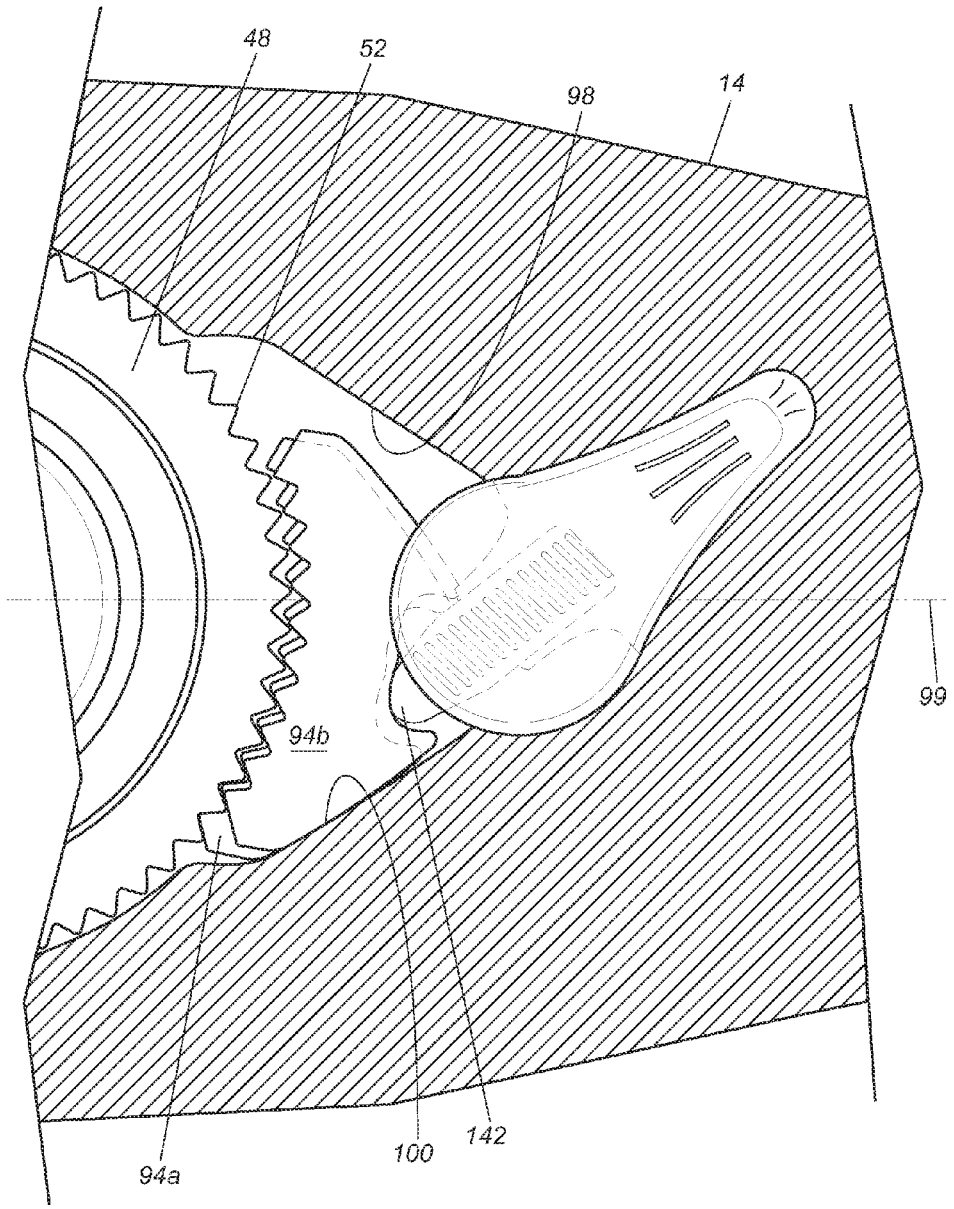
Figure 4B:
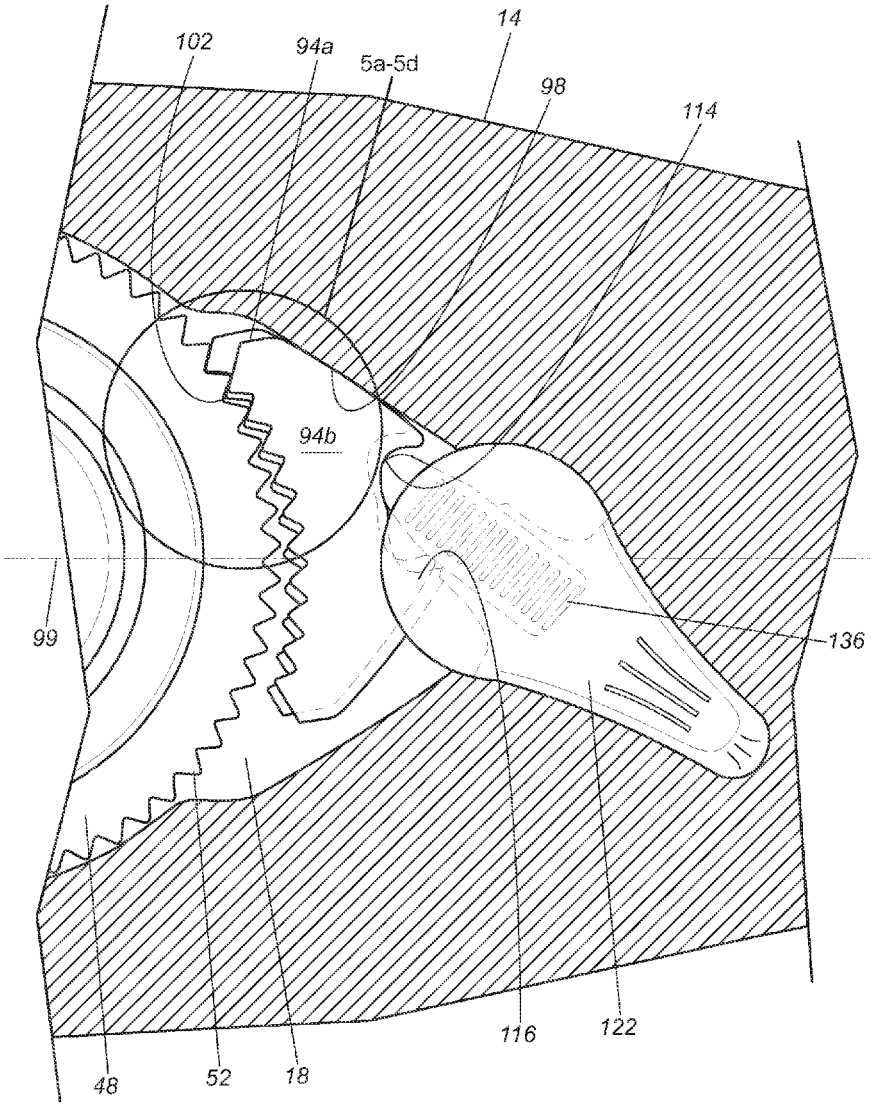
Figure 4C:
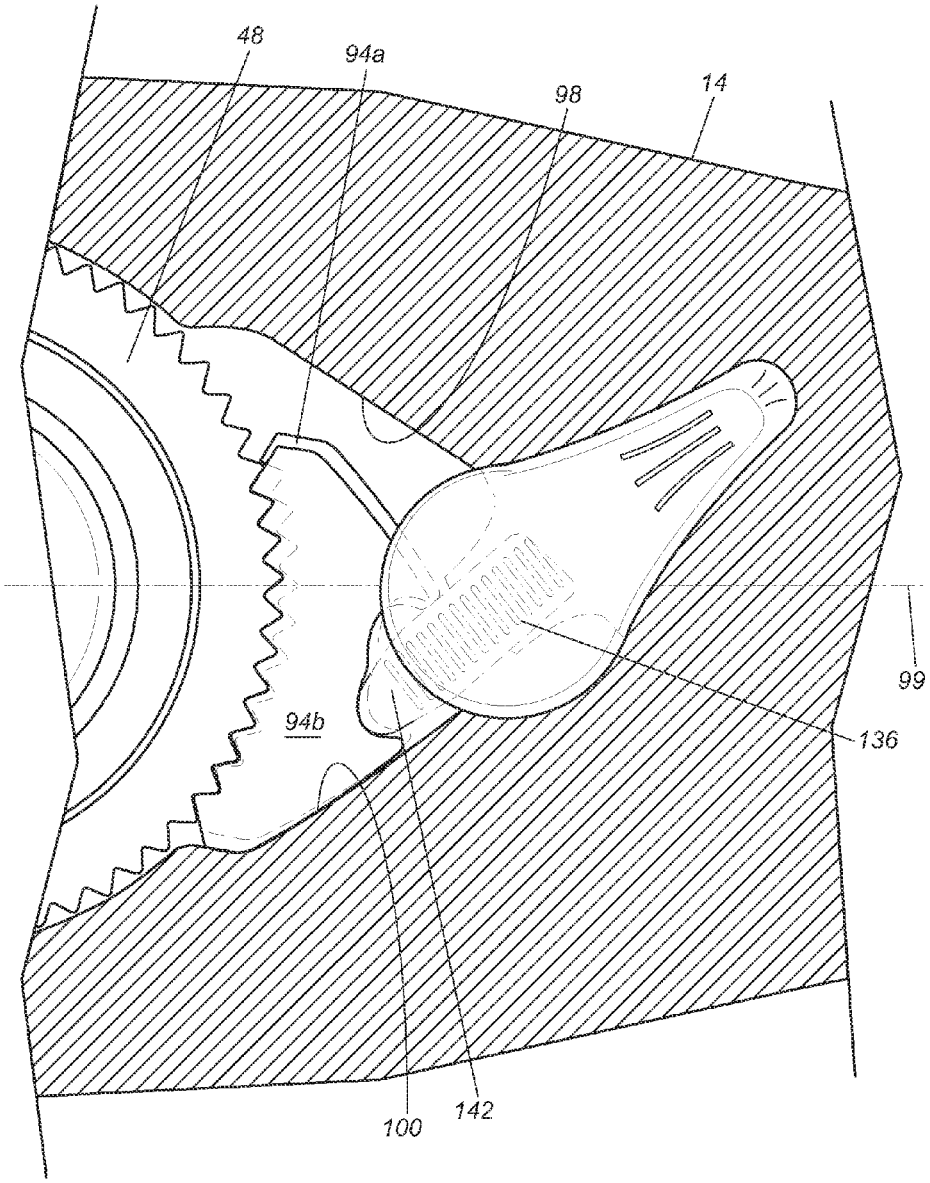
Figure 4D:
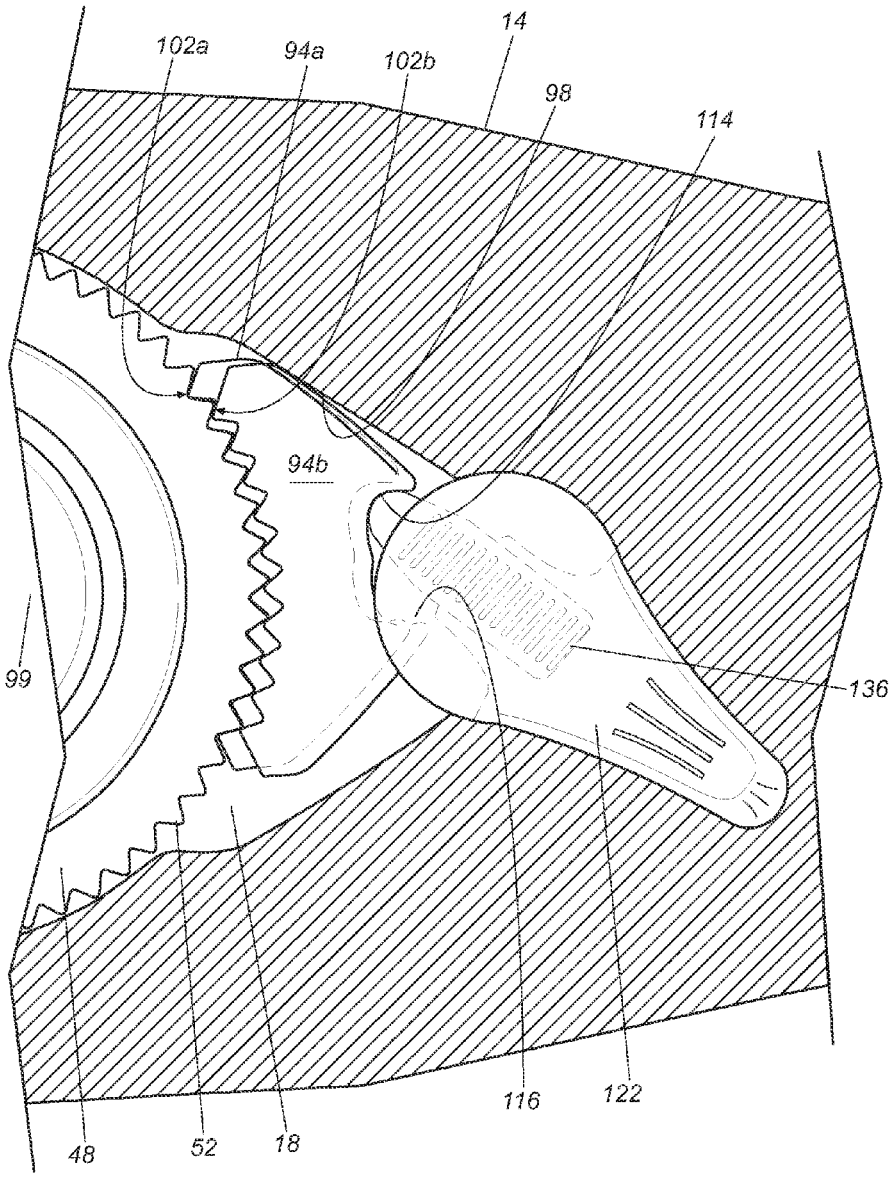

In operation, as shown in FIGS. 4A and 4B, lower and upper pawls 94*a* and 94*b* may slide to either side of compartment 18 laterally with respect to the gear between two positions in which the pawl is wedged between the body and the gear. In FIG. 4B, lever 122 is rotated to its most clockwise position, and both lower pawl 94*a* and upper pawl 94*b* are wedged between gear ring 48 and top side 98 of compartment 18. Lower and upper springs 136*a* and 136*b* push lower and upper pushers 138*a* and 138*b*, respectively, forward so that the pushers' front ends 142 engage the respective pocket sides 114 and thereby bias the respective pawls to the wedged position. Note, FIG. 4B shows the positions of upper and lower pawls 94*a* and 94*b* relative to gear ring 48 at the onset of the ratcheting process. As such, the faces and, therefore, teeth 102 of upper and lower pawls 94*a* and 94*b*, are disengaged from gear teeth 52 as the pawls are pivoted away from the gear about their outermost teeth 102*a* and 102*b*, as discussed in greater detail below. However, if torque is applied to handle 12 (FIG. 2) in the clockwise direction when a socket on the gear extension engages a work piece, the top side of compartment 18 pushes pawl teeth 102 of the lower and upper pawls 94*a* and 94*b* against opposing gear teeth 52 as best seen in FIG. 4D. As shown, during application of torque, upper and lower pawls 94*a* and 94*b* pivot inwardly towards gear ring 48, with lower pawl 94*a*, in the instant case, being fully engaged with the gear ring. That is, the pawls remain wedged between the gear ring and the compartment's top edge, and the force applied from the operator's hand to the pawl through top side 98 is therefore applied in the clockwise direction to the work piece through gear ring 48. FIG. 4C shows the application of torque to a fastener when lever 122 is rotated in its most counter-clockwise position and both lower and upper pawls 94*a* and 94*b* are wedged between gear ring 48 and bottom side 100 of compartment 18.

Figure 5A:
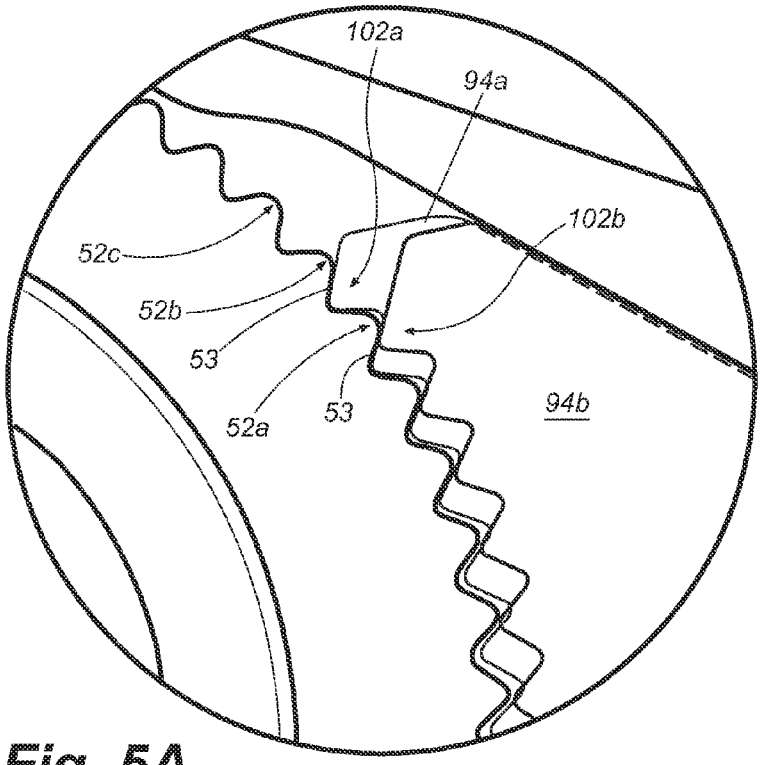

Referring additionally to FIGS. 5A through 5D, if an operator applies torque to the handle in the counter-clockwise direction, gear teeth 52 apply a counterclockwise reaction force to lower and upper pawls 94*a* and 94*b*. As best seen in FIG. 5A, at the onset of the ratcheting process, an outermost tooth 102*a* of bottom pawl 94*a* is fully seated between gear teeth 52*a* and 52*b*, whereas the tip of an outermost tooth 102*b* of upper pawl 94*b* is disposed at approximately the midpoint of a leading edge 53 of gear tooth 52*a*. If gear ring 48 remains rotationally fixed to a work piece through a socket, gear teeth 52 hold the pawls so that the pawls pivot slightly relative to gear ring 48 in from the top end of the pawl (as viewed in FIG. 4B) and moves back and down into compartment 18. As the operator applies increasing torque to the handle, the torque eventually overcomes the biasing force of springs 136*a* and 136*b*. This causes pawl pocket sides 114 (FIGS. 7 and 8) of both lower and upper pawls 94*a* and 94*b* to push back against the respective pusher tips 142 and the force of the corresponding springs. Eventually, outermost teeth 102*a* and 102*b* of lower and upper pawls 94*a* and 94*b*, respectively, begin to slide radially outward along leading edges 53 of gear teeth 52*b* and 52*a*, respectively. Springs 136*a* and 136*b* continue to bias lower and upper pushers 138*a* and 138*b*, respectively, forward against sides 114 of their respective pawl pockets 104, forcing both pawls back up toward the top face of compartment 18. As such, lower and upper pawls 94*a* and 94*b* maintain contact with side wall 98 of compartment 18 while ratcheting occurs. As previously noted, the pitch of both the gear teeth and pawl teeth in the present embodiment is 6°. As such, a rotation of 6° of the wrench handle is required for both outermost teeth 102*a* and 102*b* to move from one trough between consecutive gear teeth to the next.

Figure 5B:
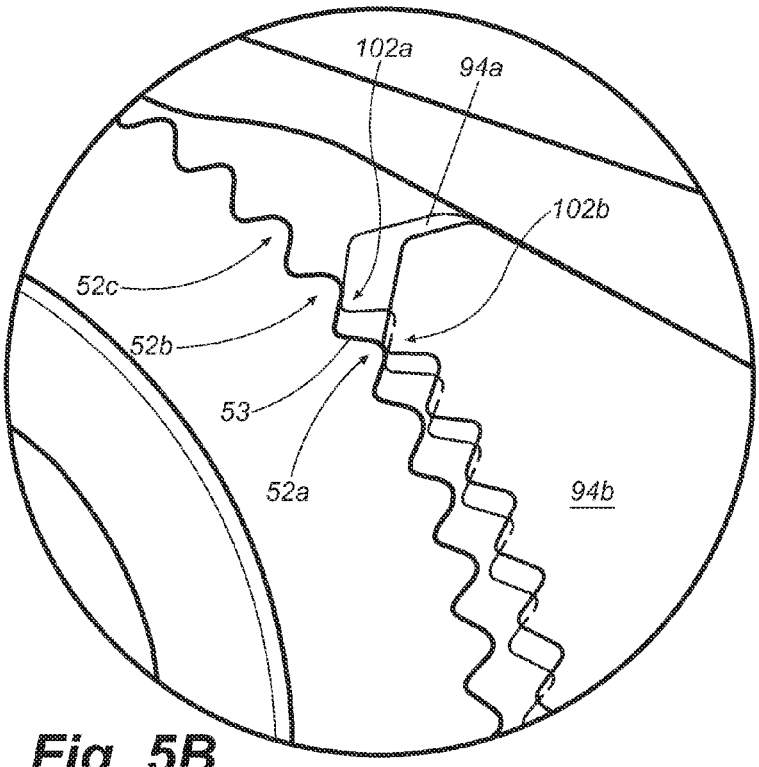

FIG. 5B shows the disposition of outermost teeth 102*a* and 102*b* after the wrench handle has been rotated through approximately 2° in the counter-clockwise direction. As shown, tooth 102*a* of lower pawl 94*a* has slid outwardly along a portion of leading edge 53 of gear tooth 52*b*. Similarly, tooth 102*b* of upper pawl 94*b* has slid outwardly along leading edge 53 of gear tooth 52*a*. Note, however, that tooth 102*b* is disposed near the outermost tip of gear tooth 52*a* since it started at a position half-way along the leading edge of gear tooth 52*a* at the onset of the ratcheting process.

Figure 5C:
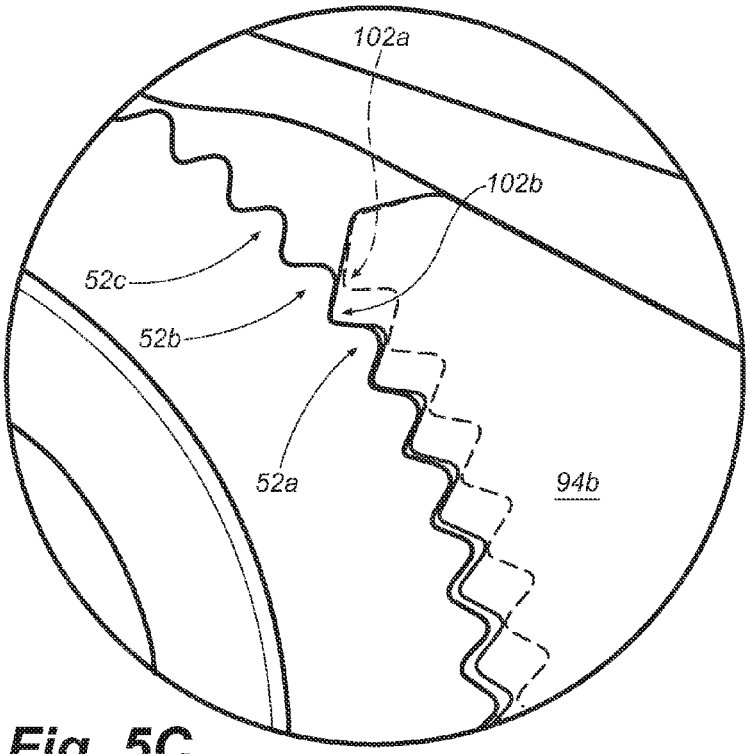

As shown in FIG. 5C, after rotation of the wrench handle through 3° in the counter-clockwise direction, tooth 102*b* of upper pawl 94*b* has cleared gear tooth 52*a* and is fully seated in the adjacent gear tooth trough. As such, the torque wrench has an effective ratcheting index of 3° between torque-applying configurations. As shown, tooth 102*a* of lower pawl 94*a* continues to slide outwardly along gear tooth 52*b*, with both teeth 102*a* and 102*b* being disposed in the same gear tooth trough.

Figure 5D:
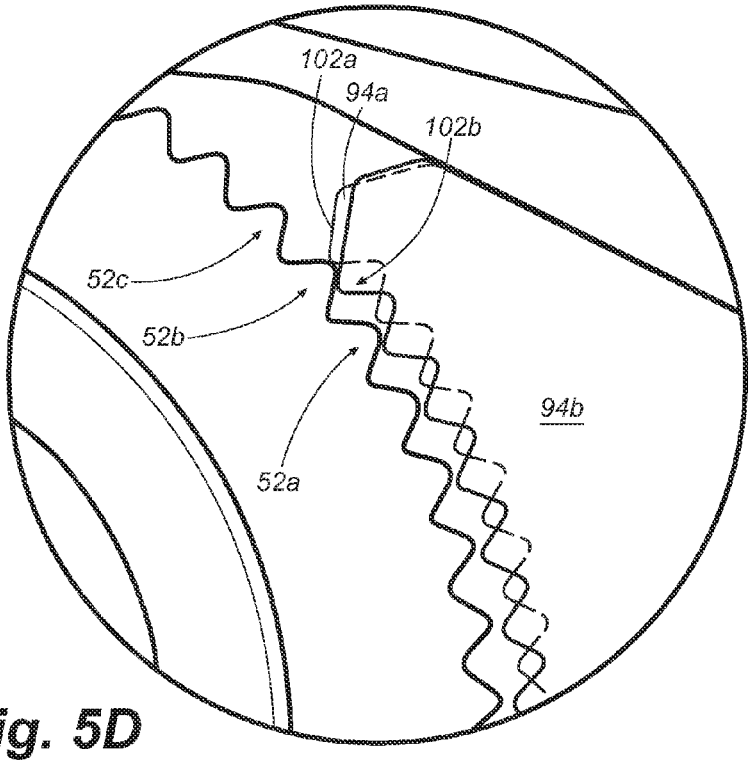

Referring now to FIG. 5D, the wrench handle has been rotated through 5° in the counter-clockwise direction. As such, tooth 102*a* has slid outwardly along almost the entire length of gear tooth 52*b*. As well, tooth 102*b* has begun to slide outwardly along leading edge 53 of tooth 52*b*. Further rotation of the wrench handle, more specifically, approximately 1° so that the entire rotation is approximately 6° from the onset, results in tooth 102*a* of lower pawl 94*a* clearing gear tooth 52*b* and being fully seated in the adjacent trough.

To change the operative direction of ratcheting tool 10, the operator rotates switch 122 in the counterclockwise direction. Lever bottom portion 126 (FIG. 2) rotates in hole 26, and the pushers move counterclockwise in the corresponding pawl pockets through curved portions 108 toward bridges 112 (FIGS. 7 and 9). Initially, the pawls pivot slightly, and the load-bearing pawl teeth of each pawl move away from the gear teeth. As the pushers move toward the corresponding bridges, each pawl begins to shift down and back in compartment 18. Further rotation brings the pushers into contact with the corresponding bridge, causing the pawl teeth to ride down and back into compartment 18 over the gear teeth. Gear ring 48 may also rotate slightly. In this position, lower and upper pawls 94*a* and 94*b* move the pushers back against the force of the springs. As the operator continues to rotate switch 122, the pushers move into the corresponding curved portions 110 and push forward against the corresponding walls 116. This applies a counterclockwise force to each pawl so that each pawl moves downward in compartment 18 and wedges between the gear ring and the compartment's bottom edge 100. When the pawls have moved over to this wedged position, the configuration and operation of the gear, the pawl, and the lever mirror the pawl's operation described above with respect to FIG. 4B. That is, the tool ratchets and applies torque to a work piece in the same manner but in the opposite direction.

As shown in FIGS. 17 and 18, a lower pawl 94*a* in accordance with an alternate embodiment of the present disclosure defines a plurality of vertically-aligned teeth 102 across the pawl's front face, wherein the front face is formed by two arc portions rather than one. As shown, both an upper arc portion 95*a*, disposed above the longitudinal center axis of the pawl, and a lower arc portion 95*b*, disposed below the longitudinal center axis of the pawl, have a radius of R1. Note, however, that the center of curvature of both upper arc portion 95*a* and lower arc portion 95*b* are offset above and below, respectively, the longitudinal center axis. As such, the arc portions do not form one continuous arc, but rather, two portions that intersect at the longitudinal center axis as shown.

In the illustrated embodiment, lower pawl 94*a* includes eleven teeth 102, the tips of the teeth are rounded slightly, and R1 is measured to the rounded tips of the teeth. The radius R1 of each arc portion is the same as a radius R2 (FIG. 6A) between the center 68 of gear ring 48 and the troughs of its teeth 52. Because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth. As well, in the embodiment shown, teeth 102 are evenly spaced on the pawl's front face so that both the upper and lower arc portions 95*a* and 95*b* of lower pawl 94*a* have the same index, that being 6°, as the gear teeth 52.

The rearward face 93 of lower pawl 94*a* defines a pocket 104 having two curved portions 108 and 110 separated by a bridge 112 and having symmetric rearwardly-extending sides 114 and 116. A notch 118 extends into the back end of lower pawl 94*a* from a bottom surface 120. The remainder of rearward face 93 of lower pawl 94*a* is defined by first and second smooth, continuous portions 93*a* and 93*b* disposed on opposite sides of pocket 104.

As shown in FIGS. 19 and 20, upper pawl 94*b* of the alternate embodiment defines a plurality of vertically-aligned teeth 102 across the pawl's front face, wherein the front face is formed by two arc portions rather than one. As shown, both an upper arc portion 97*a*, disposed above the longitudinal center axis of the pawl, and a lower arc portion 97*b*, disposed below the longitudinal center axis of the pawl, have a radius R1. Note, however, that the center of curvature of both upper arc portion 97*a* and lower arc portion 97*b* are offset above and below, respectively, the longitudinal center axis. As such, the arc portions do not form one continuous arc, but rather, two portions that intersect at the longitudinal center axis as shown.

In the illustrated embodiment, upper pawl 94*b* includes ten teeth 102, the tips of the teeth are rounded slightly, and R1 is measured to the rounded tips of the teeth. The radius R1 is the same as a radius R2 (FIG. 6A) between the center 68 of gear ring 48 and the troughs of its teeth 52. Similarly to lower pawl 94*a*, because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth. As well, in the embodiment shown, teeth 102 are evenly spaced on the pawl's front face so that upper pawl 94*b* has the same index, that being 6°, as the gear teeth 52.

Additionally, rearward face 93 of upper pawl 94*b* defines a pocket 104 having two curved portions 108 and 110 separated by a bridge 112 and having symmetric rearwardly-extending sides 114 and 116. Similarly to lower pawl 94*a*, the remainder of rearward face 93 of upper pawl 94*b* is defined by first and second smooth, continuous portions 93*a* and 93*b* disposed on opposite sides of pocket 104. Preferably, first and second portions 93*a* and 93*b* of upper pawl's rearward face 93 are formed identically to first and second portions 93*a* and 93*b* of lower pawl's rearward face 93.

Referring now to FIG. 21, a top view of upper and lower pawls 94*b* and 94*a* in a stacked configuration is provided in which the rearward faces, more specifically, first and second portions 93*a* and 93*b* of each rearward face, of upper pawl 94*b* and lower pawl 94*a*, are vertically aligned. As well, the pawls are positioned such that their longitudinal center axes lie in a common vertical plane. As previously discussed, gear ring 48 preferably defines 60 gear teeth 52 evenly spaced about its outer circumference, meaning the teeth are disposed every 6°. Similarly, teeth 102 of lower pawl 94*a* and upper pawl 94*b* are disposed along the respective upper and lower arc portions of their front faces at 6° increments. Note, however, that when their longitudinal center axes are aligned, teeth 102 of lower pawl 94*a* are circumferentially offset from teeth 102 of upper pawl 94*b* by approximately one-half pitch, meaning by approximately 3° in the present case. As previously discussed, the effect of the circumferential offset of the pawl teeth is equivalent to doubling the number of gear teeth 52 from 60 teeth to 120 teeth. As such, the ratcheting index of the wrench is decreased from approximately 6° to approximately 3°.

Still referring to FIG. 21, in the embodiment shown, upper and lower arc portions 95*a* and 95*b* defined by teeth 102 of lower pawl 94*a* are offset from the corresponding upper and lower arc potions 97*a* and 97*b* defined by teeth 102 of upper pawl 94*b* in a direction that is parallel to the longitudinal center axes of the pawls. In short, the net effect of the offset is that the pawl having the fewer number of teeth, that being upper pawl 94*b*, is "thicker" than the lower pawl 94*a* in a direction parallel to the longitudinal center axes of the pawl. As shown, the offset (X) is preferably between approximately 0.002 to 0.008 inches, most preferably being approximately 0.005 inches.

The operation of the ratcheting tool including upper and lower pawls 94*a* and 94*b* (as shown in FIGS. 17 through 21) is substantially the same as the previously discussed embodiment of the disclosed ratchet wrench. As such, a discussion of the present embodiment is not required here, and is omitted.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. For example, the number of gear teeth can be more or less than the disclosed 60 teeth, the number of teeth on the pawls can vary, the radius of curvature of the arc defined by the teeth on one or both pawls can be greater than or less than the radius of curvature of the gear teeth, the pawl having the greater number of teeth can be disposed on top of the pawl having fewer teeth, the pawl having the reduced number of teeth can be the "thinner" pawl in the direction parallel to the longitudinal center axes of the pawls, etc. Therefore, it is contemplated that any and all such embodiments are included in the present invention as may fall within the scope of the appended claims.

What is claimed is:

1. A ratcheting tool, the ratcheting tool comprising: a head and a handle attached to the head;

a gear ring disposed in the head rotatably about a vertical axis and defining a first plurality of teeth about an outer circumference of the gear ring so that the first plurality of teeth define a first arc having a first radius;

a first pawl disposed in the head so that the first pawl is slidable laterally with respect to a longitudinal center axis of the handle between a first position in which the first pawl is disposed between the head and the gear ring so that the head transmits torque through the first pawl in a first rotational direction, and a second position in which the first pawl is disposed between the head and the gear ring so that the head transmits torque through the first pawl in an opposite second rotational direction, the first pawl defining a front face and a rearward face extending between an upper surface and a lower surface of the first pawl, and a second plurality of teeth on the front face of the first pawl for engaging the first plurality of teeth, the front face being concave so that the second plurality of teeth defines at least one second arc having a second radius; and a second pawl disposed in the head above the first pawl in a direction parallel to the axis of the gear ring and so that the second pawl is slidable laterally with respect to the longitudinal center axis of the handle between a first position in which the second pawl is disposed between the head and the gear ring so that the head transmits torque through the second pawl in the first rotational direction, and a second position in which the second pawl is disposed between the head and the gear ring so that the head transmits torque through the second pawl in the opposite second rotational direction, the second pawl defining a front face and a rearward face extending between an upper surface and a lower surface of the second pawl, and a third plurality of teeth on the front face of the second pawl for engaging the first plurality of teeth, the front face of the second pawl being concave so that the third plurality of teeth defines at least one third arc having a third radius, wherein the first pawl and the second pawl are configured so that if the first pawl and the second pawl are disposed with the rearward faces of the first pawl and the second pawl in vertical alignment and so that a common vertical plane bisects each of the first pawl and the second pawl, the at least one second arc of the first pawl and the at least one third arc of the second pawl are offset from each other in a direction in the common vertical plane and perpendicular to the vertical axis of the gear ring, and wherein a first length extends linearly between respective outermost teeth on opposing ends of the second plurality of teeth, a second length extends linearly between respective outermost teeth on opposing ends of the third plurality of teeth, and, one of the first length and the second length is greater than the other of the first length and the second length.

2. The ratcheting tool of claim 1, wherein the first arc is defined by a plurality of troughs disposed between the first plurality of teeth, the at least one second arc is defined by tips of the second plurality of teeth and the at least one third arc is defined by tips of the third plurality of teeth.

3. The ratcheting tool of claim 1, wherein the offset between the at least one second arc and the at least one third arc is between 0.002 to 0.008 inches.

4. The ratcheting tool of claim 1, wherein the offset between the at least one second arc and the at least one third arc is approximately 0.005 inches.

5. The ratcheting tool of claim 1, wherein the first radius, the second radius and the third radius are substantially the same length.

6. The ratcheting tool of claim 1, wherein the second plurality of teeth of the first pawl and the third plurality of teeth of the second pawl comprise different numbers of teeth.

7. The ratcheting tool of claim 1, wherein a maximum width of the first pawl perpendicular to the common vertical plane is substantially the same as a maximum width of the second pawl perpendicular to the common vertical plane.

8. The ratcheting tool of claim 1, the ratcheting tool further comprising:

a pocket defined in the rearward face of the first pawl, and a shelf formed in the lower surface of the first pawl; and a lever defining a lip protruding therefrom and an arm protruding therefrom, the lever being disposed in the head in driving engagement with the first pawl and the second pawl so that actuation of the arm of the lever drives the first and the second pawls between their respective first positions and their respective second positions, wherein the lip is received by the first pawl shelf, and wherein the first pawl moves both parallel to and perpendicular to the longitudinal center axis of the handle when ratcheting occurs.

9. The ratcheting tool of claim 1, wherein the first pawl is symmetrical about a vertical plane bisecting the first pawl, and the second pawl is symmetrical about a vertical plane bisecting the second pawl.

10. The ratcheting tool of claim 9, wherein the first pawl and second pawl are configured so that if the first pawl and the second pawl are disposed with the rearward faces of the first and second pawls in vertical alignment and the first and second pawls bisected by the common vertical plane, the second plurality of teeth is circumferentially offset with respect to the third plurality of teeth.

11. The ratcheting tool of claim 10, wherein the circumferential offset between the second and the third pluralities of teeth is approximately one-half tooth width.

12. The ratcheting tool of claim 1, comprising at least one resilient element disposed between the head or the handle and the rearward faces of the first pawl and second pawl, biasing the first pawl and the second pawl toward the gear ring, and wherein the rearward face of the front pawl is defined by a surface of the first pawl engaged by the at least one resilient element and the rearward face of the second pawl is defined by a surface of the second pawl engaged by the at least one resilient element.

13. The ratcheting tool of claim 12, wherein the at least on resilient element comprises a first spring and pin disposed between the head or the handle and the rearward face of the first pawl and a second spring and pin disposed between the head or handle and the rearward face of the second pawl.

14. A ratcheting tool, the ratcheting tool comprising: a head and a handle attached to the head;

a gear ring disposed in the head rotatably about a vertical axis and defining a first plurality of teeth about an outer circumference of the gear ring;

a first pawl disposed in the head so that the first pawl is slidable laterally and longitudinally with respect to a longitudinal center axis of the handle between a first position in which the first pawl is disposed between the head and the gear ring so that the head transmits torque through the first pawl in a first rotational direction, and a second position in which the first pawl is disposed between the head and the gear ring so that the head transmits torque through the first pawl in an opposite second rotational direction, the first pawl defining a front face and a rearward face extending between an upper surface and a lower surface of the first pawl, and a second plurality of teeth on the front face of the first pawl for engaging the first plurality of teeth, the front face being concave; and a second pawl disposed in the head so that the second pawl is slidable laterally and longitudinally with respect to the longitudinal center axis of the handle between a first position in which the second pawl is disposed between the head and the gear ring so that the head transmits torque through the second pawl in the first rotational direction, and a second position in which the second pawl is disposed between the head and the gear ring so that the head transmits torque through the second pawl in the opposite second rotational direction, the second pawl defining a front face and a rearward face extending between an upper surface and a lower surface of the second pawl, and a third plurality of teeth on the front face of the second pawl for engaging the first plurality of teeth, the front face of the second pawl being concave, wherein the first pawl and the second pawl are configured so that if the first pawl and the second pawl are disposed with the rearward faces of the first pawl and the second pawl in vertical alignment and so that a common vertical plane bisects each of the first pawl and the second pawl, the second plurality of teeth of the first pawl is offset from the third plurality of teeth of the second pawl in a direction in the common vertical plane and perpendicular to the vertical axis of the gear ring, and wherein a first length extends linearly between respective outermost teeth on opposing ends of the second plurality of teeth, a second length extends linearly between respective outermost teeth on opposing ends of the third plurality of teeth, and, one of the first length and the second length is greater than the other of the first length and the second length.

15. The ratcheting tool of claim 14, wherein the offset from the second plurality of teeth of the first pawl to the third plurality of teeth of the second pawl in the direction is between 0.002 and 0.008 inches.

16. The ratcheting tool of claim 14, wherein the offset from the second plurality of teeth of the first pawl to the third plurality of teeth of the second pawl in the direction is approximately 0.005 inches.

17. The ratcheting tool of claim 14, wherein:

the first plurality of teeth of the gear ring defines a first arc having a first radius, the second plurality of teeth of the first pawl defines a second arc having a second radius, the third plurality of teeth of the second pawl defines a third arc having a third radius, and the second radius and the third radius are substantially the same length.

18. The ratcheting tool of claim 17, wherein the first radius is substantially the same length as each of the second radius and the third radius.

19. The ratcheting tool of claim 18, wherein the first arc is defined by a plurality of troughs disposed between the first plurality of teeth, the second arc is defined by tips of the second plurality of teeth and the third arc is defined by tips of the third plurality of teeth.

20. The ratcheting tool of claim 14, wherein the second plurality of teeth of the first pawl and the third plurality of teeth of the second pawl comprise different numbers of teeth.

21. The ratcheting tool of claim 14, the ratcheting tool further comprising:

a pocket defined in the rearward face of the first pawl, and a shelf formed in the lower surface of the first pawl; and a lever defining a lip protruding therefrom and an arm protruding therefrom, the lever being disposed in the head in driving engagement with the first pawl and the second pawl so that actuation of the arm of the lever drives the first and the second pawls between their respective first positions and their respective second positions, wherein the lip is received by the first pawl shelf.

22. The ratcheting tool of claim 14, wherein the first plurality of teeth defines a first arc having a first radius.

23. The ratcheting tool of claim 22, wherein:

the second plurality of teeth of the first pawl includes a first tooth portion defining a second arc having a second radius and a second tooth portion defining a third arc having a third radius, and a position of a center of curvature of the second arc differs from a position of a center of curvature of the third arc.

24. The ratcheting tool of claim 23, wherein:

the third plurality of teeth of the second pawl includes a first tooth portion defining a fourth arc having a fourth radius and a second tooth portion defining a fifth arc having a fifth radius, and a position of the center of curvature of the fourth arc differs from a position of the center of curvature of the fifth arc.

25. The ratcheting tool of claim 24, wherein:

the center of curvature of the second arc and the center of curvature of the third arc are on opposite sides of the common vertical plane, and the center of curvature of the fourth arc and the center of curvature of the fifth arc are on opposite sides of the common vertical plane.

26. The ratcheting tool of claim 24, wherein the second radius, the third radius, the fourth radius and the fifth radius are substantially the same length.

27. The ratcheting tool of claim 26, wherein the first radius is substantially the same length as the second radius.

28. The ratcheting tool of claim 14, wherein the first pawl is symmetrical about a vertical plane bisecting the first pawl, and the second pawl is symmetrical about a vertical plane bisecting the second pawl.

29. The ratcheting tool of claim 28, wherein the first pawl and second pawl are configured so that if the first pawl and the second pawl are disposed with the rearward faces of the first and second pawls in vertical alignment and the first and second pawls bisected by the common vertical plane, the second plurality of teeth is circumferentially offset with respect to the third plurality of teeth when the center axes of the first pawl and the second pawl are disposed in a common vertical plane.

30. The ratcheting tool of claim 28, wherein the circumferential offset between the second and the third pluralities of teeth is approximately one-half tooth width.

31. The ratcheting tool of claim 14, comprising at least one resilient element disposed between the head or the handle and the rearward faces of the first pawl and second pawl, biasing the first pawl and the second pawl toward the gear ring, and wherein the rearward face of the front pawl is defined by a surface of the first pawl engaged by the at least one resilient element and the rearward face of the second pawl is defined by a surface of the second pawl engaged by the at least one resilient element.

32. A ratcheting tool, the ratcheting tool comprising: a head and a handle attached to the head;

a gear ring disposed in the head and defining a first plurality of teeth about an outer circumference of the gear ring;

a first pawl disposed in the head so that the first pawl is slidable laterally with respect to a longitudinal center axis of the handle between a first position in which the first pawl is disposed between the head and the gear ring so that the head transmits torque through the first pawl in a first rotational direction, and a second position in which the first pawl is disposed between the head and the gear ring so that the head transmits torque through the first pawl in an opposite second rotational direction, the first pawl defining a front face and a rearward face extending between an upper surface and a lower surface of the first pawl, and a second plurality of teeth on the front face of the first pawl for engaging the first plurality of teeth, the front face being concave so that the second plurality of teeth defines at least one first arc, wherein the rearward face of the first pawl is separated from the at least one first arc by a first offset in a direction perpendicular to an axis of the gear ring; and a second pawl disposed in the head above the first pawl in a direction parallel to the axis of the gear ring and so that the second pawl is slidable laterally with respect to the longitudinal center axis of the handle between a first position in which the second pawl is disposed between the head and the gear ring so that the head transmits torque through the second pawl in the first rotational direction, and a second position in which the second pawl is disposed between the head and the gear ring so that the head transmits torque through the second pawl in the opposite second rotational direction, the second pawl defining a front face and a rearward face extending between an upper surface and a lower surface of the second pawl, and a third plurality of teeth on the front face of the second pawl for engaging the first plurality of teeth, the front face of the second pawl being concave so that the third plurality of teeth defines at least one second arc, wherein the rearward face of the second pawl is separated from the at least one second arc by a second offset in a direction perpendicular to the axis of the gear ring, wherein one of the first offset and the second offset is less than the other of the first offset and the second offset, and wherein a first length extends linearly between respective outermost teeth on opposing ends of the second plurality of teeth, a second length extends linearly between respective outermost teeth on opposing ends of the third plurality of teeth, and, one of the first length and the second length is greater than the other of the first length and the second length.

33. The ratcheting tool of claim 32, wherein the rearward face of the first pawl and the rearward face of the second pawl have corresponding shapes.

* * * * *